US008786542B2

(12) United States Patent
Morimoto

(10) Patent No.: US 8,786,542 B2
(45) Date of Patent: Jul. 22, 2014

(54) DISPLAY DEVICE INCLUDING FIRST AND SECOND SCANNING SIGNAL LINE GROUPS

(75) Inventor: Takashi Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1021 days.

(21) Appl. No.: 12/735,652

(22) PCT Filed: Jan. 3, 2009

(86) PCT No.: PCT/JP2009/051786

§ 371 (c)(1),
(2), (4) Date: Aug. 5, 2010

(87) PCT Pub. No.: WO2009/101877

PCT Pub. Date: Aug. 20, 2009

(65) Prior Publication Data

US 2011/0012932 A1 Jan. 20, 2011

(30) Foreign Application Priority Data

Feb. 14, 2008 (JP) ..... 2008-032963
May 26, 2008 (JP) ..... 2008-136544

(51) Int. Cl.
*G09G 3/36* (2006.01)
*G09G 5/00* (2006.01)

(52) U.S. Cl.
USPC ..... 345/103; 345/92; 345/95; 345/210

(58) Field of Classification Search
CPC . G09G 3/3611; G09G 3/3648; G09G 3/3666; G09G 3/367; G09G 3/3674; G09G 3/3677; G09G 3/3696
USPC ..... 345/55, 78, 87–103, 208–215, 690
See application file for complete search history.

(56) References Cited

U.S. PATENT DOCUMENTS 4,955,697 A * 9/1990 Tsukada et al. ..... 349/38
5,963,190 A 10/1999 Tsuboyama et al.

(Continued)

FOREIGN PATENT DOCUMENTS

JP 04-309995 A 11/1992
JP 07-140933 A 6/1995

(Continued)

*Primary Examiner* — Joe H Cheng
*Assistant Examiner* — Keith Crawley
(74) *Attorney, Agent, or Firm* — Harness, Dickey & Pierce, P.L.C.

(57) ABSTRACT

A display device is disclosed which is capable of suppressing characteristic changes due to a long period of conduction, thereby achieving high-quality video display, and also to provide a drive method therefor. In at least one embodiment, while sequentially activating n first scanning signal line groups $G_{1(1)}$ to $G_{1(n)}$, a predetermined voltage, which is the same as a voltage for turning off a thin-film transistor included in each pixel formation portion in that the polarity thereof is negative and is at a higher level than that voltage, is applied simultaneously to n second scanning signal line groups $G_{2(1)}$ to $G_{2(n)}$. Thereafter, while sequentially activating the n second scanning signal line groups $G_{2(1)}$ to $G_{2(n)}$, the predetermined voltage is applied simultaneously to the n first scanning signal line groups $G_{1(1)}$ to $G_{1(n)}$. By repeating this, charges accumulated in the vicinity of the thin-film transistors are eliminated, thereby suppressing changes in off characteristics thereof. At least one embodiment of the present invention is suitable for matrix display devices intended for a long period of use.

9 Claims, 15 Drawing Sheets

(56) References Cited

U.S. PATENT DOCUMENTS

| | | | | |
|---|---|---|---|---|
| 5,986,631 | A * | 11/1999 | Nanno et al. | 345/94 |
| 6,034,747 | A | 3/2000 | Tanaka et al. | |
| 7,561,136 | B2 * | 7/2009 | Hong et al. | 345/98 |
| 7,773,067 | B2 * | 8/2010 | Chang et al. | 345/95 |
| 7,800,569 | B2 * | 9/2010 | Chen et al. | 345/92 |
| 2002/0158860 | A1 * | 10/2002 | Yang | 345/209 |
| 2002/0175887 | A1 * | 11/2002 | Yamazaki | 345/87 |
| 2004/0001054 | A1 * | 1/2004 | Nitta et al. | 345/204 |
| 2004/0263452 | A1 * | 12/2004 | Kim | 345/87 |
| 2006/0077163 | A1 * | 4/2006 | Yanagi et al. | 345/94 |
| 2006/0164380 | A1 * | 7/2006 | Yang et al. | 345/103 |

FOREIGN PATENT DOCUMENTS

| | | | |
|---|---|---|---|
| JP | 07-199154 | A | 8/1995 |
| JP | 08-152600 | A | 6/1996 |
| JP | 09152628 | A | 6/1997 |
| JP | 3211256 | B2 | 9/2001 |
| JP | 3604106 | B | 12/2004 |

* cited by examiner

DISPLAY DEVICE INCLUDING FIRST AND SECOND SCANNING SIGNAL LINE GROUPS

TECHNICAL FIELD

The present invention relates to active-matrix display devices and drive methods thereof, more particularly to an active-matrix display device and a drive method therefor in which characteristic changes resulting from a long period of conduction are suppressed.

BACKGROUND ART

As displays for television, personal computer, etc., active-matrix liquid crystal display devices have been used which are capable of high-quality video display. Liquid crystal display devices include pixel formation portions each being provided with a thin film transistor (hereinafter, referred to as a "TFT") and a pixel electrode. In the case where the TFT is on, when a potential corresponding to video to be displayed is applied to the pixel electrode through a video signal line via the TFT, a voltage (gate-off voltage) for turning off a gate of the TFT is applied to the gate until another potential corresponding to the next video to be displayed is applied. As a result, the TFT is maintained in off state until the next potential is applied, so that the potential corresponding to video to be displayed is held in the pixel formation portion.

However, if the liquid crystal display device, which has a liquid crystal panel provided therein, is subjected to a long period of conduction, TFTs experience a change in off characteristics. As a result, in the case of, for example, a normally black liquid crystal panel (which appears black when no voltage is applied) having N-channel TFTs formed thereon, when a gate voltage is raised from the level of the gate-off voltage, the luminance of video displayed in white is reduced and the video appears as if it is displayed in gray. The gate voltage when the video appears as if it is displayed in gray is called a blurring voltage. The blurring voltage falls as a period of conduction increases, and stops falling when it reaches a predetermined value. In this case, the gate-off voltage needs to be set considering the fall of the blurring voltage, resulting in inconveniences such as the need to enhance a withstanding voltage of a gate driver.

The following are possible reasons why the blurring voltage falls as the period of conduction to the liquid crystal display device increases. Specifically, as the period of conduction increases, a charge is accumulated in the vicinity of a TFT channel region, and an inversion layer is formed in the channel region due to the accumulated charge. As a result, a leakage current flows through the inversion layer formed in the TFT, which is supposed to be in off state. This results in a reduction of the potential corresponding to video to be displayed, which is held in the pixel formation portion, so that the luminance of the video falls. Also, as the period of conduction increases, the amount of accumulated charge increases correspondingly, and therefore the blurring voltage falls, facilitating flow of the leakage current.

Japanese Laid-Open Patent Publication No. 9-152628 describes the fall of the blurring voltage being suppressed by forming a conducting film above the TFT channel region via an interlayer insulating film.

[Patent Document 1] Japanese Laid-Open Patent Publication No. 9-152628

DISCLOSURE OF THE INVENTION

Problems to be Solved by the Invention

As the liquid crystal display device becomes widely used in various fields including television, a higher display quality is required for the liquid crystal display device. Accordingly, to enhance the display quality, there is a need to suppress the fall of the blurring voltage caused by the characteristic changes due to a long period of conduction.

Therefore, an objective of the present invention is to provide a display device capable of suppressing characteristic changes due to a long period of conduction, thereby achieving high-quality video display, and also to provide a drive method therefor.

Solution to the Problems

A first aspect of the present invention is directed to an active-matrix display device for providing gradation display of video, comprising:

a display portion including a plurality of scanning signal lines, a plurality of video signal lines crossing the scanning signal lines, and pixel formation portions arranged in a matrix at corresponding intersections of the scanning signal lines and the video signal lines, the pixel formation portions each including a switching element to be brought into on or off state in accordance with a signal applied to a corresponding scanning signal line;

a scanning signal line driver circuit for selectively activating the scanning signal lines; and a video signal line driver circuit for applying a video signal representing video to be displayed to the video signal lines, wherein, the scanning signal line driver circuit applies a predetermined pulse to each of the scanning signal lines during a period in which the scanning signal line is not active, the predetermined pulse having the same polarity as an off voltage for bringing the switching element into off state and being at a higher level than the off voltage.

In a second aspect of the present invention, based on the first aspect of the invention, the scanning signal lines include first and second scanning signal line groups each comprising of a plurality of adjacent scanning signal lines, the scanning signal line driver circuit includes a first scanning signal line driver circuit for activating the first scanning signal line group and a second scanning signal line driver circuit for activating the second scanning signal line group, and the first and second scanning signal line driver circuits simultaneously apply the predetermined pulse to either the first or second scanning signal line group during a period in which the other scanning signal line group is active.

In a third aspect of the present invention, based on the first aspect of the invention, the scanning signal line driver circuit includes:

a successive-pulse generation circuit for generating a succession of pulses;

a predetermined-pulse generation circuit for generating the predetermined pulse based on a preceding group of pulses among the succession of pulses, and an activation-pulse generation circuit for generating activation pulses to activate the scanning signal lines based on following pulses.

In a fourth aspect of the present invention, based on the third aspect of the invention, the predetermined-pulse generation circuit generates a succession of the predetermined pulses.

In a fifth aspect of the present invention, based on the third aspect of the invention, the predetermined-pulse generation circuit generates the predetermined pulse having a pulse width of one horizontal period or more.

In a sixth aspect of the present invention, based on the second or third aspect of the invention, further comprised are a first power supply for outputting a first voltage, a second power supply for outputting a second voltage, and a third power supply for outputting a third voltage, wherein, the scanning signal line driver circuit selectively applies the first, second, and third voltages to the scanning signal lines, such that the first voltage brings the switching element into on state, the second voltage brings the switching element into off state, and the third voltage eliminates a charge accumulated in the pixel formation portion.

In a seventh aspect of the present invention, based on the sixth aspect of the invention, further comprised are first and second changeover means for changing between the second and third power supplies, wherein, the first changeover means makes a change from the second power supply to the third power supply and provides an output to the second scanning signal line driver circuit during a period in which the first scanning signal line group is active, and the second changeover means makes a change from the second power supply to the third power supply and provides an output to the first scanning signal line driver circuit during a period in which the second scanning signal line group is active.

In an eighth aspect of the present invention, based on the sixth aspect of the invention, further comprised are third and fourth changeover means for changing between the first and third power supplies, wherein, the third changeover means makes a change between the first and third power supplies and sequentially provides outputs to the scanning signal line driver circuit, the fourth changeover means makes a change between the first and third power supplies with opposite phases to the third changeover means, and sequentially provides outputs to the scanning signal line driver circuit, and the scanning signal line driver circuit sequentially applies the first and third voltages to the scanning signal lines such that one of the voltages is applied to odd-numbered ones of the scanning signal lines and the other voltage to even-numbered ones of the scanning signal lines.

In a ninth aspect of the present invention, based on the sixth aspect of the invention, further comprised are fifth, sixth, and seventh changeover means for changing between the first and third power supplies, wherein, the fifth changeover means makes a change between the first and third power supplies and sequentially provides outputs to the scanning signal line driver circuit, the sixth changeover means makes a change between the first and third power supplies with opposite phases to the fifth changeover means, and sequentially provides outputs to the scanning signal line driver circuit, the seventh changeover means makes a change between the first and third power supplies with different phases from the fifth and sixth changeover means, and sequentially provides outputs to the scanning signal line driver circuit, and the scanning signal line driver circuit sequentially selects the fifth, sixth, and seventh changeover means in a cyclical manner, and applies the third voltage and then the first voltage to the scanning signal lines while sequentially shifting the phases of the voltages line by line.

A tenth aspect of the present invention is directed to a display method for an active-matrix display device for providing gradation display of video, including a plurality of scanning signal lines, a plurality of video signal lines crossing the scanning signal lines, and a plurality of pixel formation portions arranged in a matrix at corresponding intersections of the scanning signal lines and the video signal lines, the pixel formation portions each including a switching element to be brought into on or off state in accordance with a signal applied to a corresponding scanning signal line, the method comprising the steps of:

applying a video signal representing video to be displayed to the video signal lines;

selectively activating the scanning signal lines; and applying a predetermined pulse to each of the scanning signal lines during a period in which the scanning signal line is not active, the predetermined pulse having the same polarity as an off voltage for bringing the switching element into off state and being at a higher level than the off voltage.

Effect of the Invention

According to the first and tenth aspects of the present invention, the scanning signal line driver circuit applies a predetermined pulse, which has the same polarity as an off voltage for the switching element and is at a higher level than the off voltage, to each scanning signal line during a period in which the scanning signal line is not active. Accordingly, it is possible to eliminate more charge accumulated in the vicinity of the switching element due to a long period of conduction to the display device. Thus, the display device can suppress characteristic changes of the switching element, thereby achieving high-quality video display.

According to the second aspect of the present invention, the predetermined pulse is applied to the second scanning signal line group when the first scanning signal line group is active and to the first scanning signal line group when the second scanning signal line group is active. In this case, the first scanning signal line driver circuit for activating the first scanning signal line group and the second scanning signal line driver circuit for activating the second scanning signal line group can be separately configured by individual IC chips, and therefore existing scanning signal line driver circuits can be diverted. Thus, it is possible to minimize production cost of the liquid crystal display device.

According to the third aspect of the present invention, the predetermined pulse is applied to the scanning signal lines and the activation pulse is applied to activate the scanning signal lines. In this case, the predetermined pulse is applied to each of the scanning signal lines immediately before application of the activation pulse, and therefore the display device can hold a voltage corresponding to video to be displayed in the pixel formation portion with a charge accumulated in the vicinity of the switching element being eliminated. Thus, it is possible to suppress characteristic changes of the switching element, thereby achieving higher-quality video display.

According to the fourth aspect of the present invention, the predetermined pulse is applied multiple times before application of the activation pulse. As a result, the period in which to apply the predetermined pulse is extended, making it possible to eliminate more charge accumulated in the vicinity of the switching element. Consequently, further higher-quality video display can be achieved.

According to the fifth aspect of the present invention, the predetermined pulse having a pulse width of one horizontal period or more is applied, making it possible to eliminate more charge accumulated in the vicinity of the switching element.

According to the sixth aspect of the present invention, it is possible to turn the switching element on when the first voltage is applied and off when the second voltage is applied, and also possible to eliminate a charge accumulated in the vicinity of the switching element when the third voltage is applied.

According to the seventh aspect of the present invention, during the time in which the first scanning signal line group is active, the first changeover means makes a change from the second power supply to the third power supply, so that the third voltage is outputted to the second scanning signal line group. Also, during the time in which the second scanning signal line group is active, the second changeover means makes a change from the second power supply to the third power supply, so that the third voltage is outputted to the first scanning signal line group. As a result, charges accumulated in the vicinity of the switching elements connected to the scanning signal line group that is not active can be eliminated. Also, by increasing the number of times the predetermined pulse is applied or by extending the period in which to apply the predetermined pulse, more accumulated charge can be eliminated.

According to the eighth aspect of the present invention, the scanning signal line driver circuit applies the predetermined pulse to even-numbered scanning signal lines while the activation pulse is being applied to odd-numbered scanning signal lines. Thereafter, the predetermined pulse is applied to the odd-numbered scanning signal lines when the activation pulse is applied to the even-numbered scanning signal lines. In this manner, the scanning signal line driver circuit applies the predetermined pulse to the scanning signal lines that are not active, thereby eliminating charges accumulated in the vicinity of the switching elements connected to the scanning signal lines. Then, the activation pulse is applied to activate the scanning signal lines. In this manner, the predetermined pulse is applied immediately before activating the scanning signal lines, eliminating accumulated charges, and therefore the liquid crystal display device can provide high-quality video display.

According to the ninth aspect of the present invention, the scanning signal line driver circuit sequentially selects the fifth, sixth, and seventh changeover means, which make changes with different phases from one another, in a cyclical manner, and sequentially applies the predetermined pulse to the scanning signal lines at different times for each line before applying the activation pulse. In this case, the number of times the predetermined pulse is applied can be increased or a pulse having a larger pulse width can be applied, and therefore more charges accumulated in the vicinity of the switching elements connected to the scanning signal lines can be eliminated. Thus, the liquid crystal display device can provide higher-quality video display.

DESCRIPTION OF THE REFERENCE CHARACTERS

Figure 1:
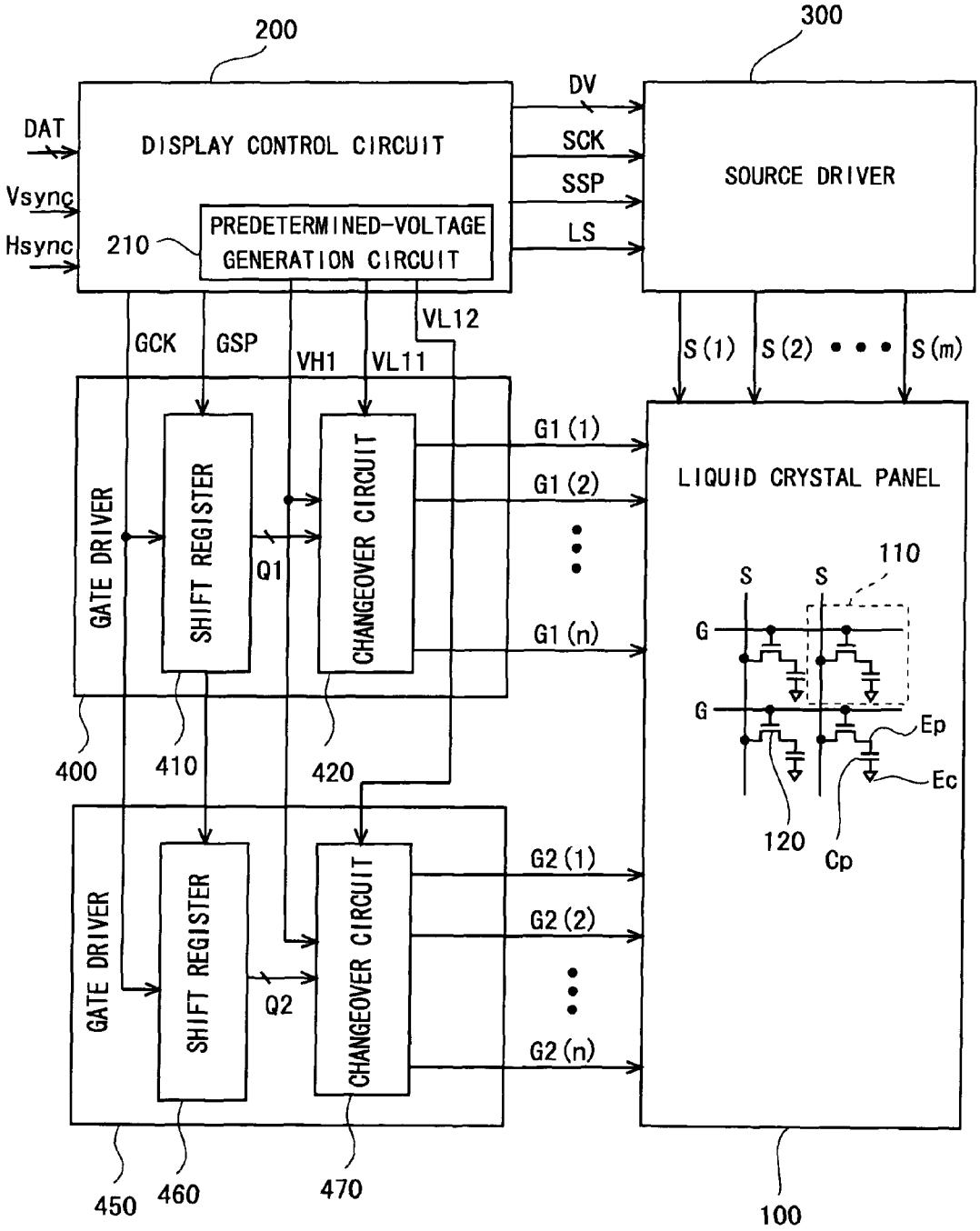
FIG. 1 is a block diagram illustrating the overall configuration of an active-matrix liquid crystal display device according to a first embodiment of the present invention.

110 pixel formation portion
210, 250, 280 predetermined-voltage generation circuit
220, 260, 290 control signal generation circuit
230*a*, 230*b*, 230*c* power supply
400, 450, 500, 600 gate driver
410, 460, 510, 610 shift register
420, 470, 520, 620 changeover circuit
630 AND circuit

BEST MODE FOR CARRYING OUT THE INVENTION

1. First Embodiment

1.1 Overall Configuration and Operation

FIG. 1 is a block diagram illustrating the overall configuration of an active-matrix liquid crystal display device according to a first embodiment of the present invention. The liquid crystal display device is provided with a liquid crystal panel 100, a display control circuit 200, a source driver (video signal line driver circuit) 300, a first gate driver (scanning signal line driver circuit) 400, and a second gate driver 450.

The liquid crystal panel 100 includes a plurality (m) of video signal lines $S_1$ to $S_m$ and a plurality (2n) of scanning signal lines $G_{1(1)}$ to $G_{1(n)}$ and $G_{2(1)}$ to $G_{2(n)}$. Of the 2n scanning signal lines, the scanning signal lines $G_{1(n)}$ to $G_{1(n)}$ are driven by the first gate driver 400, while the scanning signal lines $G_{2(1)}$ to $G_{2(n)}$ are driven by the second gate driver 450.

The liquid crystal panel 100 further includes a plurality (m×2n) of pixel formation portions 110 provided at their respective intersections of the m video signal lines $S_1$ to $S_m$ and the 2n scanning signal lines $G_{1(1)}$ to $G_{1(n)}$) and $G_{2(1)}$ to $G_{2(n)}$. Each pixel formation portion 110 consists of: an N-channel TFT 120, which has a gate terminal connected to a scanning signal line passing through a corresponding intersection and a source terminal connected to a video signal line passing through that intersection; a pixel electrode $E_p$ connected to a drain terminal of the TFT 120; a common electrode $E_c$ provided in common to the pixel formation portions 110; and a liquid crystal layer sandwiched between the pixel electrode $E_p$ and the common electrode $E_c$. A pixel capacitance $C_p$ is made up of the pixel electrode $E_p$, the common electrode $E_c$, and the liquid crystal layer.

The display control circuit 200 receives a data signal DAT, a vertical synchronization signal $V_{sync}$, and a horizontal synchronization signal $H_{sync}$, which are transmitted externally, and outputs a digital video signal DV to the source driver 300 as well as a source start pulse signal SSP, a source clock signal SCK, and a latch strobe signal LS, which are intended to control the timing of displaying video on the liquid crystal panel 100. In addition, the display control circuit 200 outputs a gate start pulse signal GSP and a gate clock signal GCK to the first gate driver 400, and also outputs a gate clock signal GCK to the second gate driver 450.

The display control circuit 200 includes a predetermined-voltage generation circuit 210. The predetermined-voltage generation circuit 210 outputs scanning signals $VH_1$ and $VL_{11}$ to the first gate driver 400 and scanning signals $VH_1$ and $VL_{12}$ to the second gate driver 450. Here, the scanning signal $VH_1$ assumes a gate-on voltage VgH for turning on the gate of the TFT 120. Also, both the scanning signals $VL_{11}$ and $VL_{12}$ are signals that change at predetermined times between a gate-off voltage VgL for turning off the gate of the TFT 120 and a predetermined voltage VgE, which has the same polarity as the gate-off voltage VgL and is higher than the gate-off voltage VgL, but the scanning signals $VL_{11}$ and $VL_{12}$ change at different times from each other. In the following descriptions, the gate-on voltage VgH is +15V, the gate-off voltage VgL is −12V, and the predetermined voltage VgE is −17V.

The source driver 300 receives the digital video signal DV, the source start pulse signal SSP, the source clock signal SCK, and the latch strobe signal LS outputted by the display control circuit 200, and applies a drive video signal to each of the video signal lines $S_{(1)}$ to $S_{(m)}$).

The first gate driver 400 is made up of a first shift register 410 and a first changeover circuit 420. The first shift register 410 sequentially outputs pulse signals $Q_{1(1)}$ to $Q_{1(n)}$ to the first changeover circuit 420 based on the gate start pulse signal GSP and the gate clock signal GCK outputted by the display control circuit 200. Based on the pulse signals $Q_{1(1)}$ to $Q_{1(n)}$ provided by the first shift register 410, the first changeover circuit 420 selects and outputs either the scanning signal or $VL_{11}$ outputted by the predetermined-voltage generation circuit 210 to each of the scanning signal lines $G_{1(1)}$ to $G_{1(n)}$.

The second gate driver 450 is made up of a second shift register 460 and a second changeover circuit 470. Based on the gate clock signal GCK outputted by the display control circuit 200 and the n'th pulse signal $Q_{1(n)}$ from the first gate driver 400, the second shift register 460 sequentially outputs pulse signals $Q_{2(1)}$ to $Q_{2(n)}$ to the second changeover circuit 470 after the first shift register 410 outputs the pulse signal $Q_{1(n)}$ to the first changeover circuit 420. Based on the pulse signals $Q_{2(1)}$ to $Q_{2(n)}$ provided by the second shift register 460, the second changeover circuit 470 selects and outputs either the scanning signal $VH_1$ or $VL_{12}$ outputted by the predetermined-voltage generation circuit 210 to each of the scanning signal lines $G_{2(1)}$ to $G_{2(n)}$.

The source driver 300 provides a potential corresponding to video to be displayed to the video signal lines $S_{(1)}$ to $S_{(m)}$, and the first and second gate drivers 400 and 450 sequentially activate the scanning signal lines $G_{1(1)}$ to $G_{1(n)}$ and $G_{2(1)}$ to $G_{2(n)}$. As a result, the potential corresponding to video to be displayed is provided to the pixel electrodes $E_p$ of the TFTs 120 connected to the activated scanning signal lines, and then applied to the liquid crystal layer between the pixel electrodes and the common electrode $E_c$. This voltage controls the amount of light to be transmitted through the liquid crystal layer, so that video is displayed on the liquid crystal panel 100.

1.2 Configurations and Operations of the First and Second Gate Drivers

Figure 2:
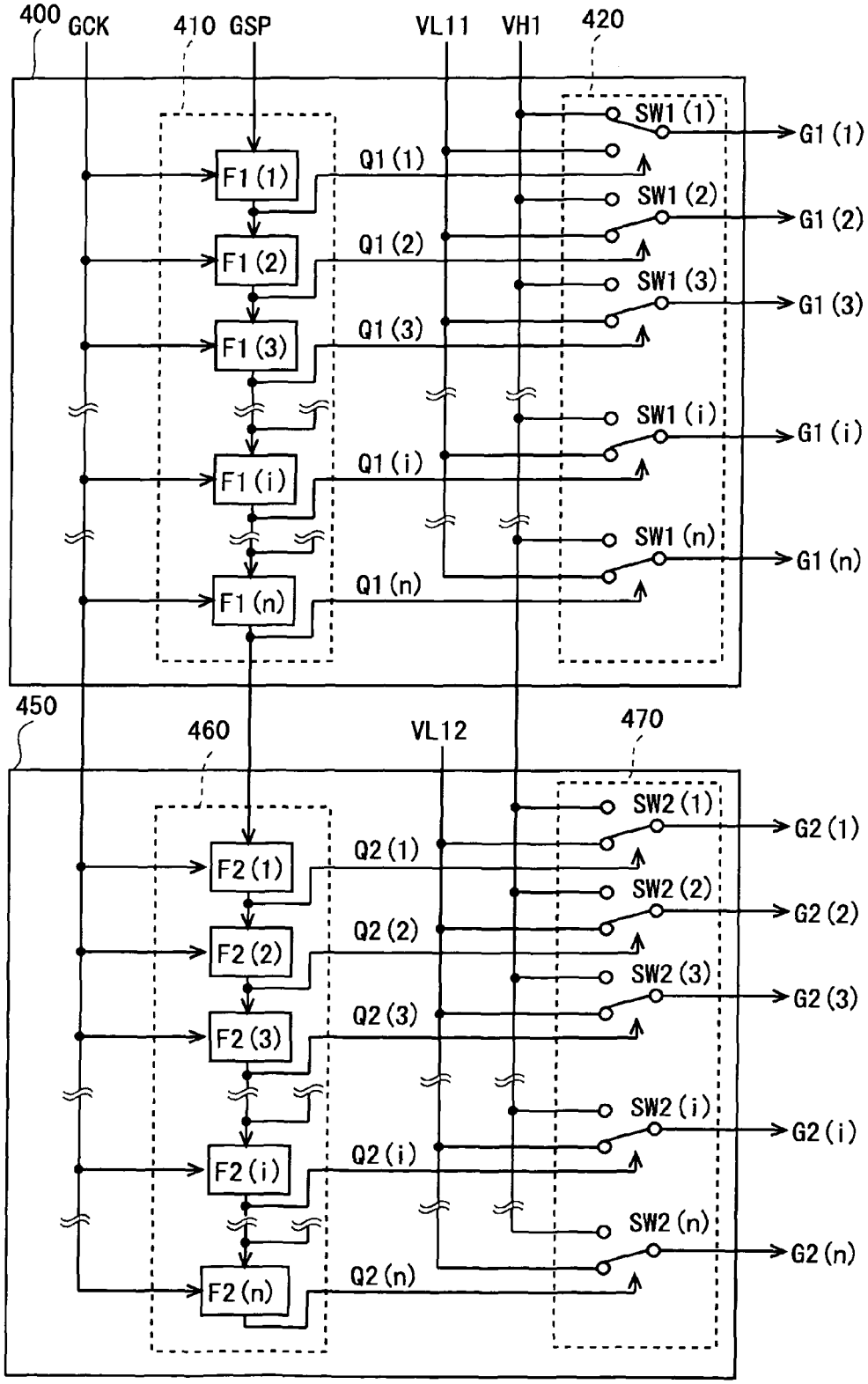
FIG. 2 is a circuit diagram illustrating the configurations of first and second gate drivers included in the liquid crystal display device shown in FIG. 1.

FIG. 2 is a circuit diagram illustrating the configurations of the first gate driver 400 and the second gate driver 450 included in the liquid crystal display device of the first embodiment. The first gate driver 400 is made up of the first shift register 410 having n flip-flops $F_{1(1)}$ to $F_{1(n)}$ cascaded and the first changeover circuit 420 having n selection provided so as to be turned on/off in accordance with their respective outputs from the n flip-flops $F_{1(1)}$ to $F_{1(n)}$.

When the gate start pulse signal GSP and the gate clock signal GCK are provided, the first shift register 410 sequentially shifts a pulse signal, which is set to high level for the same period as one pulse cycle of the gate clock signal GCK, from the first-stage flip-flop $F_{1(1)}$ to the n'th-stage flip-flop $F_{1(n)}$) of the first shift register 410 at intervals of one horizontal period (hereinafter, referred to as "1H period"). Correspondingly, the flip-flops $F_{1(1)}$ to $F_{1(n)}$ in the first through n'th stages of the first shift register 410 sequentially output pulse signals $Q_{1(1)}$ to $Q_{1(n)}$, which are set to high level for the same period as one pulse cycle of the gate clock signal GCK.

The selection switch $SW_{1(i)}$ (where i is an integer from 1 to n) selects and outputs the scanning signal $VH_1$ to the scanning signal line $G_{1(i)}$ when a high-level pulse signal $Q_{1(i)}$ is provided by the i'th-stage flip-flop $F_{1(i)}$ corresponding thereto, whereas it selects and outputs the scanning signal $VL_{11}$ to the scanning signal line $G_{1(1)}$ when a low-level pulse signal $Q_{1(i)}$ is provided.

Similarly, the second gate driver 450 is made up of the second shift register 460 having n flip-flops $F_{2(1)}$ to $F_{2(n)}$ cascaded and the second changeover circuit 470 having n selection switches $SW_{2(1)}$ to $SW_{2(n)}$ connected in parallel with then flip-flops, respectively. When the second shift register 460 is provided with the output $Q_{1(n)}$ from the n'-stage flip-flop $F_{1(n)}$ of the first shift register 410 along with the gate clock signal GCK, the second shift register 460 sequentially shifts a pulse signal, which is set to high level for the same period as one pulse cycle of the gate clock signal GCK, from the first-stage flip-flop $F_{2(1)}$ to the n'th-stage flip-flop $F_{2(n)}$ of the second shift register 460 at intervals of 1H period. Correspondingly, the flip-flops $F_{2(1)}$ to $F_{2(n)}$ in the first to n'th stages of the second shift register 460 sequentially output the pulse signals $Q_{2(1)}$ to $Q_{2(n)}$, which are set to high level for the same period as one pulse cycle of the gate clock signal GCK. The selection switches $SW_{2(1)}$ to $SW_{2(n)}$ each select and output a scanning signal $VH_1$ to the scanning signal line $G_{2(i)}$ when a high-level pulse signal $Q_{2(i)}$ from a corresponding i'th-stage flip-flop $F_{2(i)}$ is provided, whereas it selects and outputs a scanning signal $VL_{12}$ to the scanning signal line $G_{2(i)}$ when a low-level pulse signal $Q_{2(i)}$ is provided.

Figure 3:
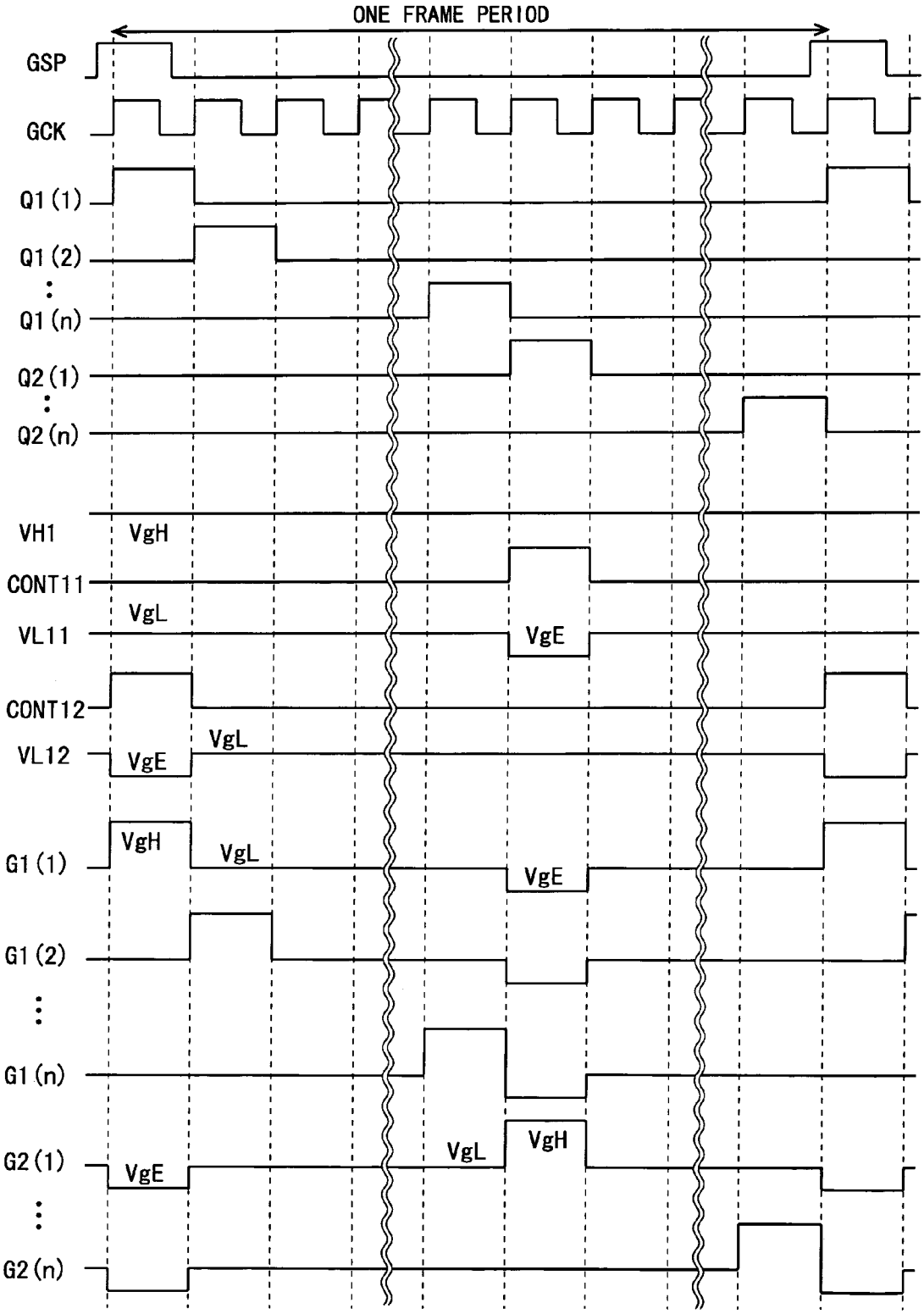
FIG. 3 is a signal waveform chart illustrating the operation of the liquid crystal display device shown in FIG. 1 for one frame period.

FIG. 3 is a signal waveform chart illustrating the operation of the liquid crystal display device of the first embodiment for one frame period. The first shift register 410 is provided with the gate start pulse signal GSP and the gate clock signal GCK, and the second shift register 460 is provided with the gate clock signal GCK. Note that the scanning signal $VH_1$ always assumes the gate-on voltage VgH, and the scanning signals $VL_{11}$ and $VL_{12}$ change from the gate-off voltage VgL to the predetermined voltage VgE for a predetermined period in accordance with first and second control signals $CONT_{11}$ and $CONT_{12}$ respectively, as will be described later.

The pulse signal $Q_{1(1)}$ outputted by the first-stage flip-flop $F_{1(1)}$ of the first shift register 410 rises with the gate clock signal GCK. At the rise of the pulse signal $Q_{1(1)}$, the selection switch $SW_{1(1)}$ changes over to select the scanning signal $VH_1$, so that the gate-on voltage VgH is outputted to the scanning signal line $G_{1(1)}$. The pulse signal $Q_{1(1)}$ falls at the next rise of the gate clock signal GCK. At this time, the selection switch $SW_{1(1)}$ changes over to select the scanning signal $VL_{11}$, so that the gate-off voltage VgL is outputted to the scanning signal line $G_{1(1)}$.

The pulse signal $Q_{1(2)}$ outputted by the second-stage flip-flop $F_{1(2)}$ rises at the fall of the pulse signal $Q_{1(1)}$. At this time, the selection switch $SW_{1(2)}$ changes over to select the scanning signal $VH_1$, so that the gate-on voltage VgH is outputted to the scanning signal line $G_{1(2)}$. Then, at the fall of the pulse signal $Q_{1(2)}$, the selection switch $SW_{1(2)}$ changes over to select the scanning signal $VL_{11}$, so that the gate-off voltage VgL is outputted to the scanning signal line $G_{1(2)}$. Subsequently, in a similar manner, when each of the third- to n'th-stage flip-flops $F_{1(i)}$ sequentially outputs one pulse signal $Q_{1(i)}$ at the rise of the gate clock signal GCK, the selection switch $SW_{1(i)}$ corresponding to the flip-flop $F_{1(i)}$ that outputted the pulse signal $Q_{1(i)}$ sequentially selects the scanning signal $VH_1$, and outputs the gate-on voltage VgH to the scanning signal line $G_{1(i)}$.

On the other hand, when the gate-on voltage VgH is outputted to the scanning signal line $G_{1(1)}$, the second control signal $CONT_{12}$ is set to high level for controlling the scanning signal $VL_{12}$ outputted by the predetermined-voltage generation circuit 210. As a result, the inputs of the selection switches $SW_{2(1)}$ to $SW_{2(n)}$ simultaneously connect to an output terminal of a −17V power supply, disconnecting from an output terminal of a −12V power supply, and therefore the predetermined voltage VgE, instead of the gate-off voltage VgL, is outputted as the scanning signal $VL_{12}$ simultaneously to the scanning signal lines $G_{2(1)}$ to $G_{2(n)}$.

Also, at the rise of the pulse signal $Q_{2(1)}$ outputted by the first-stage flip-flop $F_{2(1)}$ of the second shift register 460, the selection switch $SW_{2(1)}$ changes over to select the scanning signal $VH_1$, so that the gate-on voltage VgH is outputted to the scanning signal line $G_{2(1)}$. Then, at the fall of the pulse signal $Q_{2(1)}$, the selection switch $SW_{2(1)}$ changes over to select the scanning signal $VL_{12}$, so that the gate-off voltage VgL is outputted to the scanning signal line $G_{2(1)}$. Subsequently, in a similar manner, when each of the second- to n'th-stage flip-flops $F_{2(i)}$ sequentially outputs one pulse signal $Q_{2(i)}$, the selection switch $SW_{2(i)}$ corresponding to the flip-flop $F_{2(i)}$ that outputted the pulse signal $Q_{2(i)}$ sequentially selects the scanning signal $VH_1$ and outputs the gate-on voltage VgH to the scanning signal line $G_{2(1)}$.

During the time in which the gate-on voltage VgH is outputted to the scanning signal line $G_{2(1)}$, the first control signal $CONT_{11}$ is set to high level for controlling the scanning signal $VL_{11}$ outputted by the predetermined-voltage generation circuit 210. As a result, the inputs of the selection switches $SW_{1(1)}$ to $SW_{1(n)}$ simultaneously connect to the output terminal of the −17V power supply, disconnecting from the output terminal of the −12V power supply, and therefore the predetermined voltage VgE, instead of the gate-off voltage VgL, is outputted as the scanning signal $VL_{11}$ simultaneously to the scanning signal lines $G_{1(1)}$ to $G_{1(n)}$.

1.3 Predetermined-Voltage Generation Circuit

Figure 4:
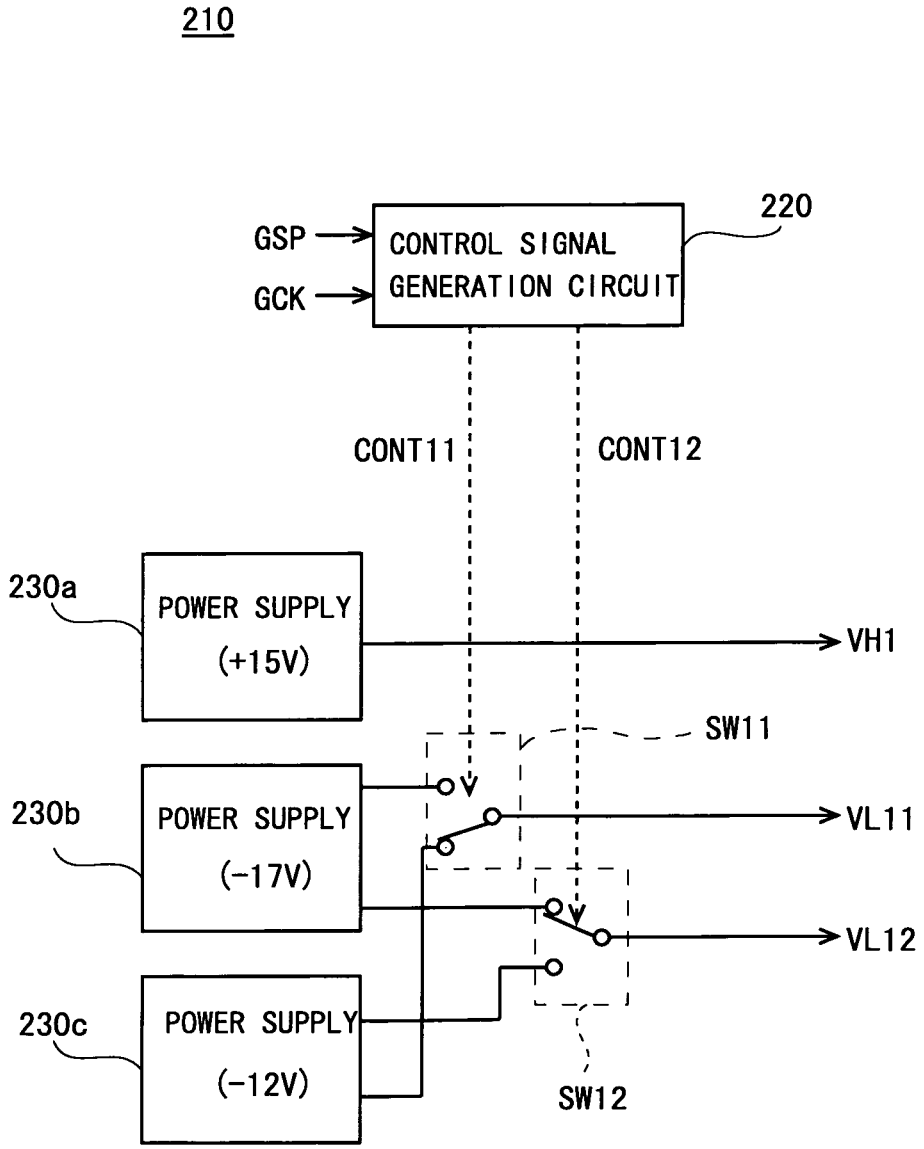
FIG. 4 is a block diagram illustrating the configuration of a predetermined-voltage generation circuit included in the liquid crystal display device shown in FIG. 1.

FIG. 4 is a block diagram illustrating the configuration of the predetermined-voltage generation circuit 210 included in the liquid crystal display device of the first embodiment. The predetermined-voltage generation circuit 210 is made up of: a control signal generation circuit 220 for generating the first control signal $CONT_{11}$ and the second control signal $CONT_{12}$; a power supply 230*a* for outputting a +15V voltage; a power supply 230*b* for outputting a −17V voltage; a power supply 230*c* for outputting a −12V voltage; a switch $SW_{11}$ for selecting and outputting either the output voltage of the power supply 230*b* or the output voltage of the power supply 230*c* to the first gate driver 400; and a switch $SW_{12}$ for selecting and outputting either the output voltage of the power supply 230*b* or the output voltage of the power supply 230*c* to the second gate driver 450, as shown in FIG. 4.

The control signal generation circuit 220 generates the first control signal $CONT_{11}$ and the second control signal $CONT_{12}$ based on the gate start pulse signal GSP and the gate clock signal GCK generated in the display control circuit 200. The generated first control signal $CONT_{11}$ controls the switch $SW_{11}$, while the second control signal $CONT_{12}$ controls the switch $SW_{12}$. Also, the +15V voltage outputted by the power supply 230*a*, the −17V voltage outputted by the power supply 230*b*, and the −12V voltage outputted by the power supply 230*c* are outputted to the first and second gate drivers 400 and 450 as the gate-on voltage VgH, the predetermined voltage VgE, and the gate-off voltage VgL, respectively.

When the first control signal $CONT_{11}$ is set to high level, the input of the switch $SW_{11}$ connects to the output terminal of the power supply 230*b*, disconnecting from the output terminal of the power supply 230*c*. Accordingly, the scanning signal $VL_{11}$ changes from the −12V voltage outputted by the power supply 230*c* to the −17V voltage outputted by the power supply 230*b*, i.e., from the gate-off voltage VgL to the predetermined voltage VgE.

Also, when the first control signal $CONT_{11}$ is set to low level, the input of the switch $SW_{11}$ connects to the output terminal of the power supply 230*c*, disconnecting from the output terminal of the power supply 230*b*. Accordingly, the scanning signal $VL_{11}$ changes from the −17V voltage outputted by the power supply 230*b* to the −12V voltage outputted by the power supply 230*c*, i.e., from the predetermined voltage VgE to the gate-off voltage VgL.

Similarly, when the second control signal $CONT_{12}$ is set to high level, the input of the switch $SW_{12}$ connects to the output terminal of the power supply 230*b*, disconnecting from the output terminal of the power supply 230*c*. Accordingly, the scanning signal $VL_{12}$ changes from the −12V voltage outputted by the power supply 230*c* to the −17V voltage outputted by the power supply 230*b*, i.e., from the gate-off voltage VgL to the predetermined voltage VgE.

Also, when the second control signal $CONT_{12}$ is set to low level, the input of the switch $SW_{12}$ connects to the output terminal of the power supply 230*c*, disconnecting from the output terminal of the power supply 230*b*. Accordingly, the scanning signal $VL_{12}$ changes from the −17V voltage outputted by the power supply 230*b* to the −12V voltage outputted by the power supply 230*c*, i.e., from the predetermined voltage VgE to the gate-off voltage VgL.

1.4 Effect

By applying the predetermined voltage VgE, a charge accumulated in the vicinity of the channel region of the TFT 120 can be eliminated, making it possible to suppress characteristic changes due to a long period of conduction to the liquid crystal display device. Thus, it is possible to suppress a reduction of the blurring voltage, thereby achieving high-quality video display.

Also, individual IC (Integrated Circuit) chips can be used separately as the first gate driver 400 and the second gate driver 450 required for generating the predetermined voltage VgE, and therefore existing gate drivers can be diverted. Thus, it is possible to minimize production cost of the liquid crystal display device.

1.5 Variants

Figure 5:
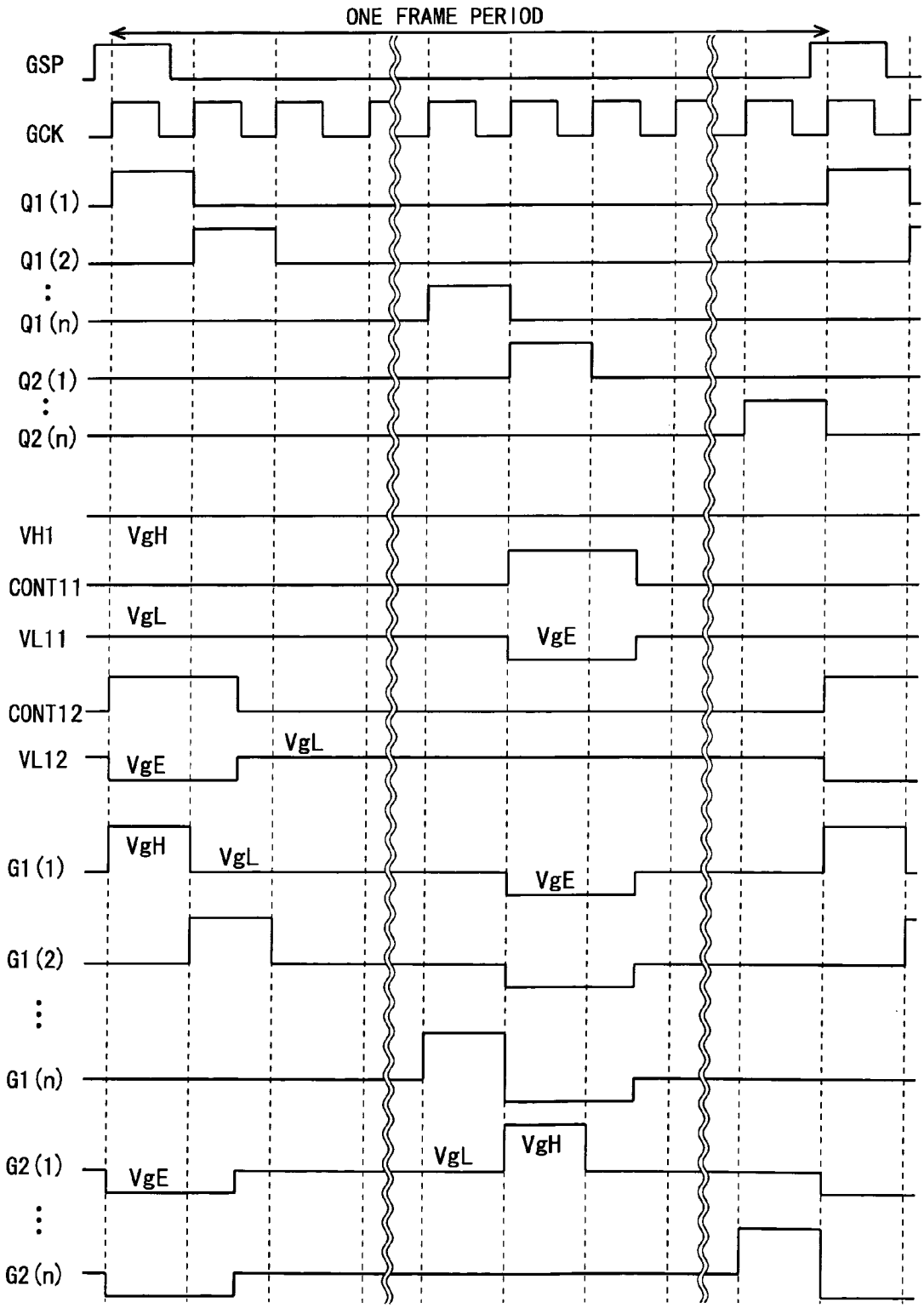
FIG. 5 is a signal waveform chart illustrating the operation of a first variant of the liquid crystal display device shown in FIG. 1 for one frame period.

FIG. 5 is a signal waveform chart illustrating the operation of a first variant of the liquid crystal display device of the first embodiment for one frame period. As shown in FIG. 5, by changing the settings of the control signal generation circuit 220, the time in which the first and second control signals $CONT_{11}$ and $CONT_{12}$ are at high level may be rendered longer than in FIG. 3. In this case, by extending the time in which the first and second control signals $CONT_{11}$ and $CONT_{12}$ are at high level, the time in which each of the scanning signals $VL_{11}$ and $VL_{12}$ is applied as the predetermined voltage VgE can be extended. The longer the time in which the predetermined VgE is applied, the more the charge accumulated in the vicinity of the channel region of the TFT 120 can be eliminated, and therefore it is possible to further suppress the characteristic changes due to a long period of conduction to the liquid crystal display device. Thus, it is possible to suppress a reduction of the blurring voltage, thereby achieving higher-quality video display.

Figure 6:
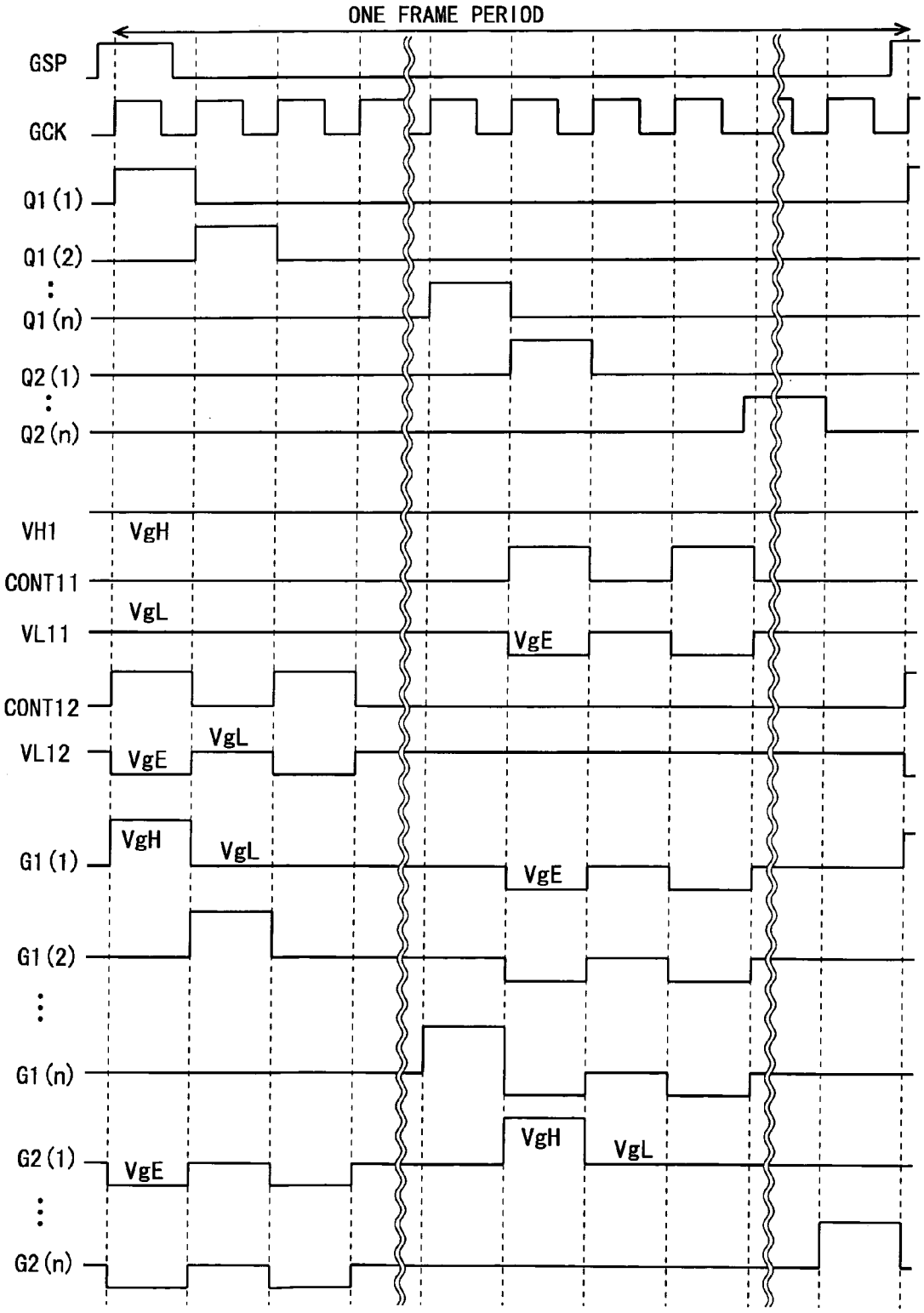
FIG. 6 is a signal waveform chart illustrating the operation of a second variant of the liquid crystal display device shown in FIG. 1 for one frame period.

FIG. 6 is a signal waveform chart illustrating the operation of a second variant of the liquid crystal display device of the first embodiment for one frame period. As shown in FIG. 6, by changing the settings of the control signal generation circuit 220, the number of times each of the first and second control signals $CONT_{11}$ and $CONT_{12}$ is set to high level may be set to twice. In this case, during the time in which the gate-on voltage VgH is outputted sequentially to the scanning signal lines $G_{1(1)}$ to $G_{1(3)}$, the second control signal $CONT_{12}$ causes the predetermined voltage VgE to be simultaneously outputted twice to each of the scanning signal lines $G_{2(1)}$ to $G_{2(n)}$. Also, during the time in which the gate-on voltage VgH is outputted sequentially to the scanning signal lines $G_{2(1)}$ to $G_{2(3)}$, the first control signal $CONT_{11}$ causes the predetermined voltage VgE to be simultaneously outputted twice to each of the scanning signal lines $G_{1(1)}$ to $G_{1(n)}$. In this case also, the time of application of the predetermined voltage VgE is extended, making it possible to further eliminate the charge accumulated in the vicinity of the channel region of the TFT 120. Therefore, it is possible to further suppress characteristic changes due to a long period of conduction to the liquid crystal display device. Thus, it is possible to suppress a reduction of the blurring voltage, thereby achieving higher-quality video display. Note that the number of applications of the predetermined voltage VgE is not limited to twice, and the higher the number, the further the characteristic changes can be suppressed.

2. Second Embodiment

2.1 Overall Configuration and Operation

Figure 7:
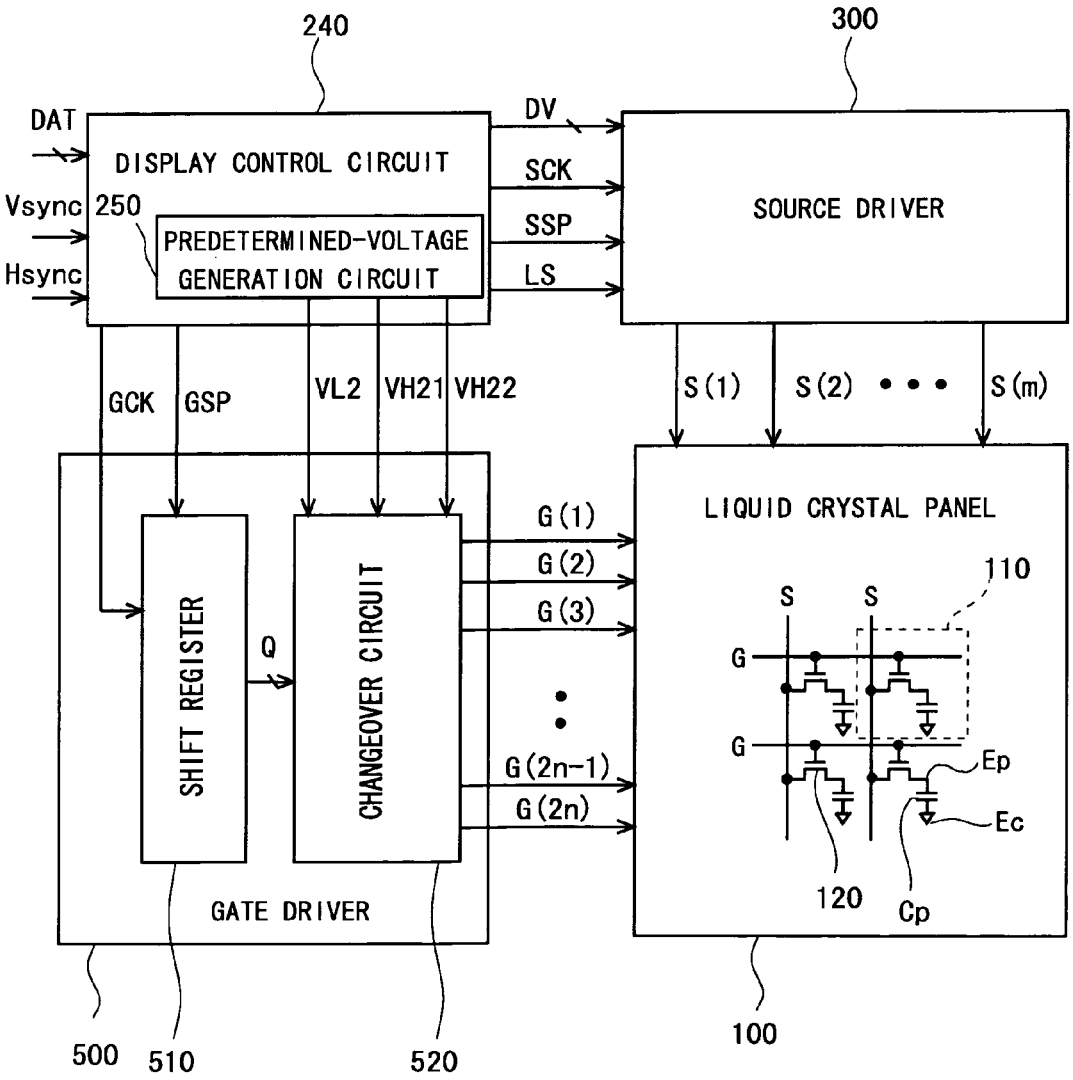
FIG. 7 is a block diagram illustrating the overall configuration of an active-matrix liquid crystal display device according to a second embodiment of the present invention.

FIG. 7 is a block diagram illustrating the overall configuration of an active-matrix liquid crystal display device according to a second embodiment of the present invention. Elements of the liquid crystal display device that are the same as those of the liquid crystal display device according to the first embodiment are denoted by the same reference characters and any descriptions thereof will be omitted.

Unlike in the first embodiment, the 2n scanning signal lines $G_{(1)}$ to $G_{(2n)}$ included in the liquid crystal panel 100 of the liquid crystal display device are driven by a gate driver 500. The gate driver 500 is made up of a shift register 510 and a changeover circuit 520. The shift register 510 sequentially outputs pulse signals $Q_{(1)}$ to $Q_{(2n)}$ to the changeover circuit 520 based on the gate start pulse signal GSP and the gate clock signal GCK outputted by the display control circuit 200. Based on the pulse signals $Q_{(1)}$ to $Q_{(2n)}$ outputted by the shift register 510, the changeover circuit 520 selects and outputs either the scanning signal $VL_2$ or $VH_{21}$ outputted by a predetermined-voltage generation circuit 250 for each of the odd-numbered scanning signal lines $G_{(1)}$ to $G_{(2n-1)}$ and also selects and outputs either the scanning signal $VL_2$ or $VH_{22}$ for each of the even-numbered scanning signal lines $G_{(2)}$ to $G_{(2n)}$.

2.2 Configuration and Operation of the Gate Driver

Figure 8:
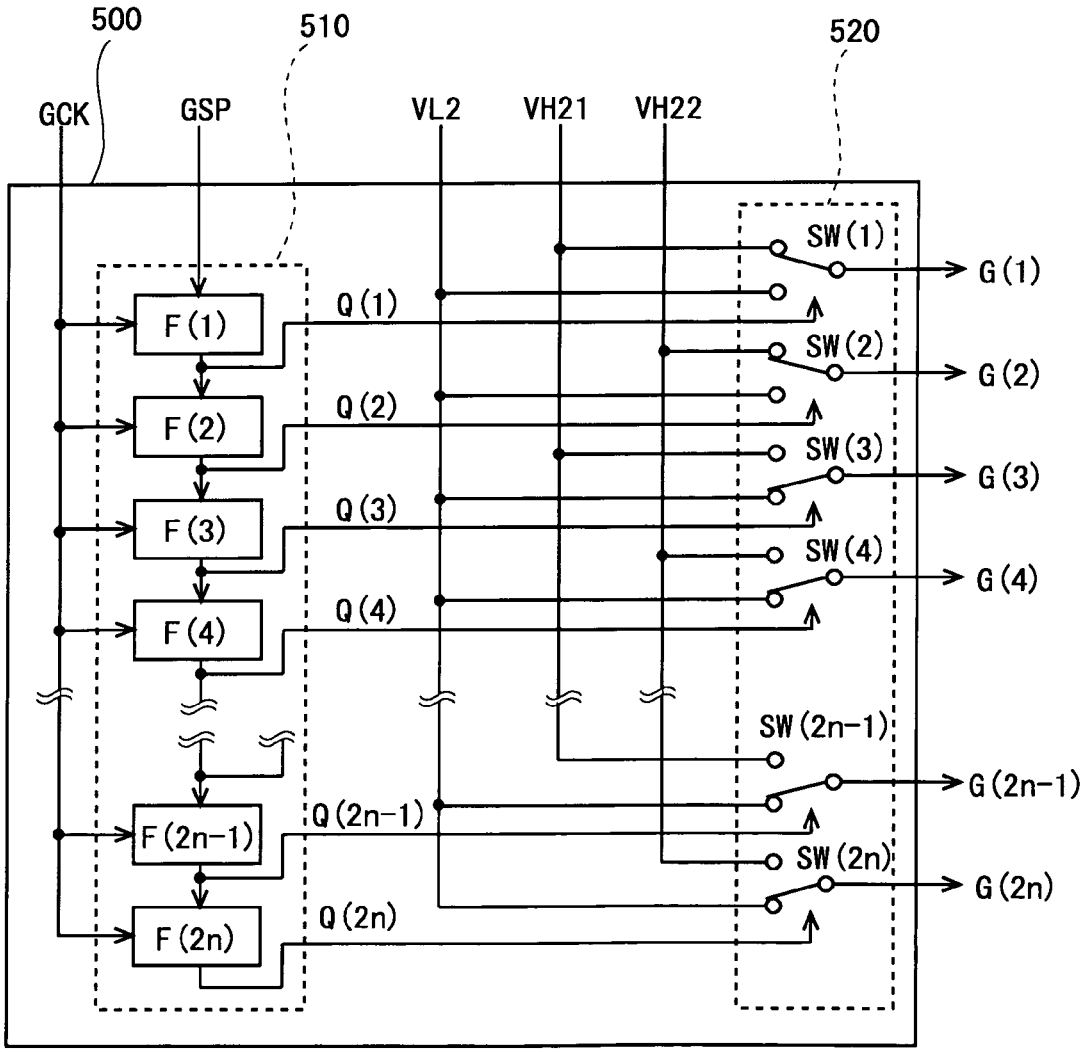
FIG. 8 is a circuit diagram illustrating the configuration of a gate driver included in the liquid crystal display device shown in FIG. 7.

FIG. 8 is a circuit diagram illustrating the configuration of the gate driver 500 included in the liquid crystal display device of the second embodiment. As shown in FIG. 8, the gate driver 500 is made up of the shift register 510 having 2n flip-flops $F_{(1)}$ to $F_{(2n)}$ cascaded and the changeover circuit 520 having 2n selection switches $SW_{(1)}$ to $SW_{(2n)}$ provided so as to be turned on/off in accordance with their respective outputs from the 2n flip-flops $F_{(1)}$ to $F_{(2n)}$.

When the shift register 510 is provided with the gate start pulse signal GSP and the gate clock signal GCK, the shift register 510 sequentially shifts a pulse signal, which is set to high level for the same period as one pulse cycle of the gate clock signal GCK, from the first-stage flip-flop $F_{(1)}$ to the 2n'th-stage flip-flop $F_{(2n)}$ at intervals of 1H period. Correspondingly, the flip-flops $F_{(1)}$ to $F_{(2n)}$ in the first to 2n'th stages of the shift register 510 sequentially output pulse signals $Q_{(1)}$ to $Q_{(2n)}$, which are set to high level for the same period as one pulse cycle of the gate clock signal GCK, at intervals of 1H period.

The selection switch $SW_{(2i-1)}$ provided corresponding to the odd-numbered flip-flop $F_{(2i-1)}$ (where i is an integer from 1 to n) selects and outputs the scanning signal $VH_{21}$ to the scanning signal line $G_{(2i-1)}$ when the flip-flop $F_{(2i-1)}$ provides a high-level pulse signal $Q_{(2i-1)}$ whereas it selects and outputs the scanning signal $VL_2$ to the scanning signal line $G_{(2i-1)}$ when a low-level pulse signal $Q_{(2i-1)}$ is provided.

The selection switch $SW_{(2i)}$ provided corresponding to the even-numbered flip-flop $F_{(2i)}$ selects and outputs the scanning signal $VH_{22}$ to the scanning signal line $G_{(2i)}$ when the flip-flop $F_{(2i)}$ provides a high-level pulse signal $Q_{(2i)}$, whereas it selects and outputs the scanning signal $VL_2$ to the scanning signal line $G_{(2i)}$ when a low-level pulse signal $Q_{(2i)}$ is provided. Note that the gate driver 500 does not have to be made of a single IC chip and may be made up of a plurality of IC chips.

Figure 9:
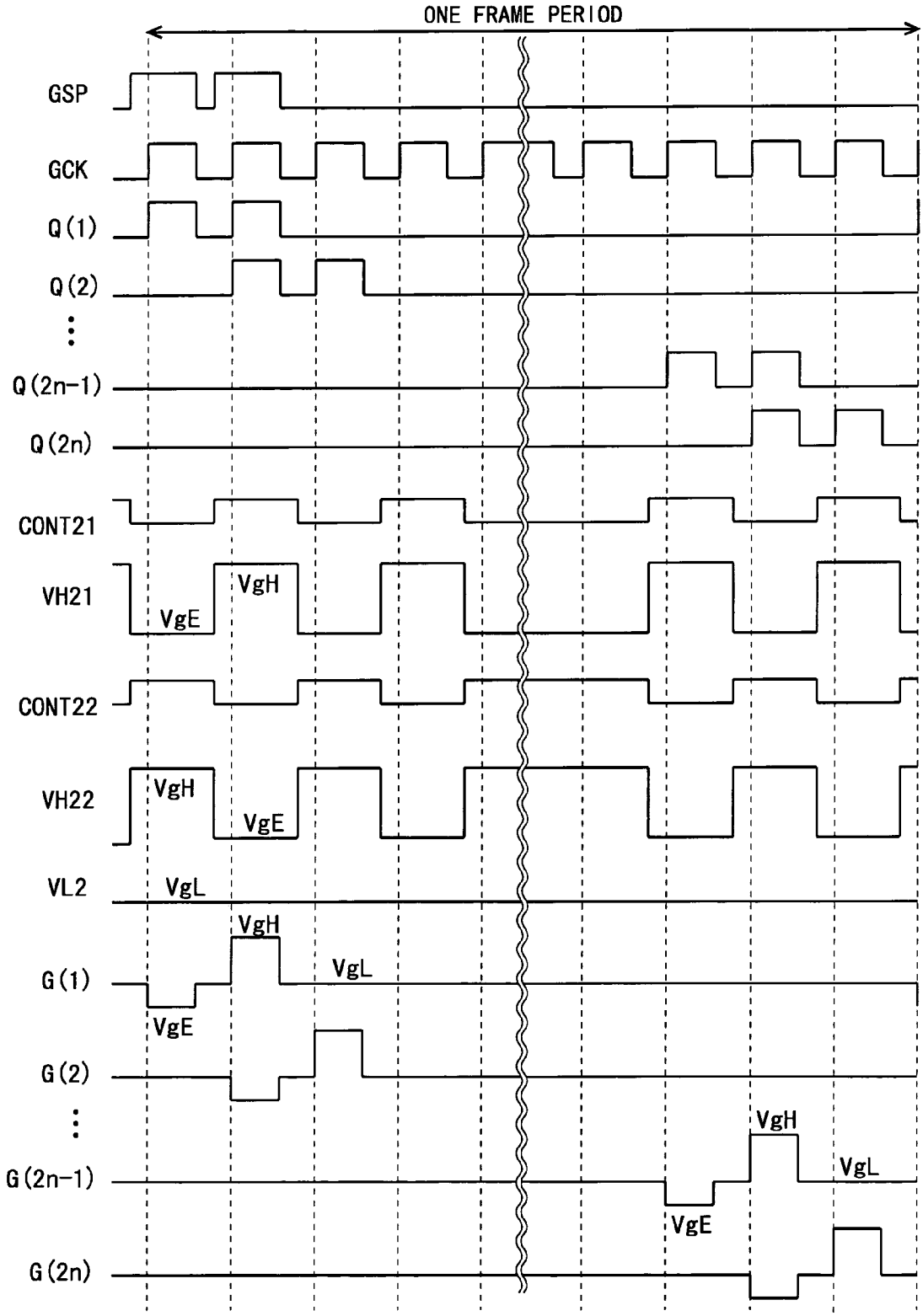
FIG. 9 is a signal waveform chart illustrating the operation of the liquid crystal display device shown in FIG. 7 for one frame period.

FIG. 9 is a signal waveform chart illustrating the operation of the liquid crystal display device of the second embodiment for one frame period. The scanning signal $VH_{21}$ is controlled by a third control signal $CONT_{21}$ so as to fall to the predetermined voltage VgE at the rise of the first pulse of the gate start pulse signal GSP consisting of two successive pulses and rise to the gate-on voltage VgH at the rise of the second pulse. Thereafter, the scanning signal $VH_{21}$ repeatedly alternates between the predetermined voltage VgE and the gate-on voltage VgH. On the other hand, the scanning signal $VH_{22}$ is controlled by a fourth control signal $CONT_{22}$ so as to repeatedly alternate between the gate-on voltage VgH and the predetermined voltage VgE in reverse phase to the scanning signal $VH_{21}$.

When the first pulse of the gate start pulse signal GSP and the gate clock signal GCK are provided to the first-stage flip-flop $F_{(1)}$ of the shift register 510, the first pulse signal $Q_{(1a)}$ outputted by the first-stage flip-flop $F_{(1)}$ of the shift register 510 rises at the rise of the gate clock signal GCK, so that the selection switch $SW_{(1)}$ changes over to select the scanning signal $VH_{21}$. At this time, the scanning signal $VH_{21}$ assumes the predetermined voltage VgE, and therefore the predetermined voltage VgE is outputted to the scanning signal line $G_{(1)}$. Then, at the fall of the pulse signal $Q_{(1a)}$, the selection switch $SW_{(1)}$ changes over to select the scanning signal $VL_2$, so that the gate-off voltage VgL is outputted to the scanning signal line $G_{(1)}$.

Then, at the rise of the second pulse signal Q(1*b*) outputted by the first-stage flip-flop $F_{(1)}$, the selection switch $SW_{(1)}$ changes over to select the scanning signal $VH_{21}$ again. At this time, since the scanning signal $VH_{21}$ has changed from the predetermined voltage VgE to the gate-on voltage VgH, the gate-on voltage VgH is outputted to the scanning signal line $G_{(1)}$. Then, at the fall of the pulse signal $Q_{(1b)}$, the selection switch $SW_{(1)}$ changes over to select the scanning signal $VL_2$ again, so that the gate-off voltage VgL is outputted to the scanning signal line $G_{(1)}$.

The first pulse signal $Q_{(2a)}$ from the second-stage flip-flop $F_{(2)}$ rises simultaneously with the second pulse signal $Q_{(1b)}$ outputted by the first-stage flip-flop $F_{(1)}$. At the rise of the first pulse signal $Q_{(2a)}$, the selection switch $SW_{(2)}$ changes over to select the scanning signal $VH_{22}$. At this time, since the scanning signal $VH_{22}$ assumes the predetermined voltage VgE, the predetermined voltage VgE is outputted to the scanning signal line $G_{(2)}$. Then, at the fall of the pulse signal $Q_{(2a)}$ the selection switch $SW_{(2)}$ changes over to select the scanning signal $VL_2$, so that the gate-off voltage VgL is outputted to the scanning signal line $G_{(2)}$.

Then, at the rise of the second pulse signal $Q_{(2b)}$ outputted by the second-stage flip-flop $F_{(2)}$, the selection switch $SW_{(2)}$ changes over to select the scanning signal $VH_{22}$ again. At this time, since the scanning signal $VH_{22}$ has changed from the predetermined voltage VgE to the gate-on voltage VgH, the gate-on voltage VgH is outputted to the scanning signal line $G_{(2)}$. Thereafter, at the fall of the pulse signal $Q_{(2b)}$, the selection switch $SW_{(2)}$ changes over to select the scanning signal $VL_2$ again, so that the gate-off voltage VgL is outputted to the scanning signal line $G_{(2)}$.

Subsequently, when an odd-numbered-stage flip-flop $F_{(2i-1)}$ sequentially outputs two pulse signals $Q_{((2i-1)a)}$ and $Q_{((2i-1)b)}$, the changeover circuit 520 outputs the predetermined voltage VgE to the scanning signal line $G_{(2i-1)}$ and then outputs the gate-on voltage VgH, as in the case where the first-stage flip-flop $F_{(1)}$ sequentially outputs two pulse signals $Q_{(1a)}$ and $Q_{(1b)}$.

Also, when an even-numbered-stage flip-flop $F_{(2i)}$ sequentially outputs two pulse signals $Q_{(2ia)}$ and $Q_{(2ib)}$, the predetermined voltage VgE is outputted to the scanning signal line $G_{(2i)}$, and then the gate-on voltage VgH is outputted, as in the case where the second-stage flip-flop $F_{(2)}$ sequentially outputs two pulse signals $Q_{(2a)}$ and $Q_{(2b)}$.

In this manner, the predetermined voltage VgE is applied to the scanning signal line $G_{(i)}$ during the period in which the i'th pulse of the gate clock signal GCK is at high level, and the gate-on voltage VgH is applied during the next high-level period. As a result, a charge accumulated in the vicinity of the channel region of the TFT 120 is eliminated, and thereafter the TFT 120 is brought into on state so that a potential corresponding to video to be displayed is provided to the pixel capacitance $C_p$. Then, by applying the gate-off voltage VgL, the TFT 120 is brought into off state, so that the provided potential is held in the pixel capacitance $C_p$.

2.3 Predetermined-Voltage Generation Circuit

Figure 10:
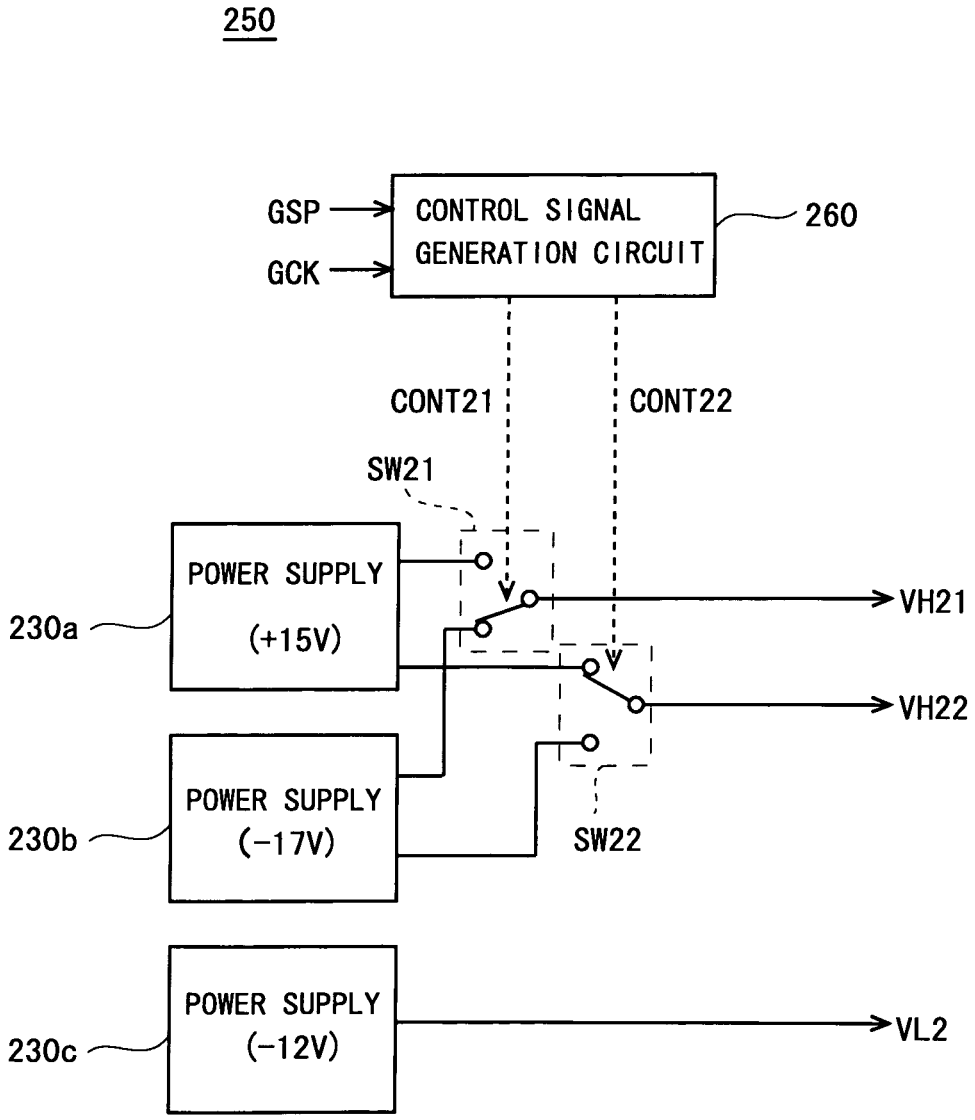
FIG. 10 is a block diagram illustrating the configuration of a predetermined-voltage generation circuit included in the liquid crystal display device shown in FIG. 7.

FIG. 10 is a block diagram illustrating the configuration of the predetermined-voltage generation circuit 250 included in the liquid crystal display device of the second embodiment. The predetermined-voltage generation circuit 250 is made up of: a control signal generation circuit 260 for generating the third control signal $CONT_{21}$ and the fourth control signal $CONT_{22}$; a power supply 230*a* for outputting a +15V voltage; a power supply 230*b* for outputting a −17V voltage; a power supply 230*c* for outputting a −12V voltage; a switch $SW_{21}$ for selecting and outputting either the output voltage of the power supply 230*a* or the output voltage of the power supply 230*b* as the scanning signal $VH_{21}$; and a switch $SW_{22}$ for selecting and outputting either the output voltage of the power supply 230*a* or the output voltage of the power supply 230*b* as the scanning signal $VH_{22}$, as shown in FIG. 10.

The control signal generation circuit 260 generates the third control signal $CONT_{21}$ and the fourth control signal $CONT_{22}$ based on the gate start pulse signal GSP and the gate clock signal GCK generated in the display control circuit 240. The generated third control signal $CONT_{21}$ controls the switch $SW_{21}$, and the fourth control signal $CONT_{22}$ controls the switch $SW_{22}$ at different times from the switch $SW_{21}$. Also, the +15V voltage outputted by the power supply 230*a*, the −17V voltage outputted by the power supply 230*b*, and the −12V voltage outputted by the power supply 230*c* are provided to the gate drivers 500 and 450 as the gate-on voltage VgH, the predetermined voltage VgE, and the gate-off voltage VgL, respectively.

When the third control signal $CONT_{21}$ is set to low level, the input of the switch $SW_{21}$ connects to the output terminal of the power supply 230*b*, disconnecting from the output terminal of the power supply 230*a*. Accordingly, the scanning signal $VH_{21}$ changes from the +15V voltage outputted by the power supply 230*a* to the −17V voltage outputted by the power supply 230*b*, i.e., from the gate-on voltage VgH to the predetermined voltage VgE.

Also, when the third control signal $CONT_{21}$ is set to high level, the input of the switch $SW_{21}$ connects to the output terminal of the power supply 230*a*, disconnecting from the output terminal of the power supply 230*b*. Accordingly, the scanning signal $VH_{21}$ changes from the −17V voltage outputted by the power supply 230*b* to the +15V voltage outputted by the power supply 230*a*, i.e., from the predetermined voltage VgE to the gate-on voltage VgH.

Similarly, when the fourth control signal $CONT_{22}$ is set to low level, the input of the switch $SW_{22}$ connects to the output terminal of the power supply 230*b*, disconnecting from the output terminal of the power supply 230*a*. Accordingly, the scanning signal $VH_{22}$ changes from the +15V voltage outputted by the power supply 230*a* to the −17V voltage outputted by the power supply 230*b*, i.e., from the gate-on voltage VgH to the predetermined voltage VgE.

Also, when the fourth control signal $CONT_{22}$ is set to high level, the input of the switch $SW_{22}$ connects to the output terminal of the power supply 230*a*, disconnecting from the output terminal of the power supply 230*b*. Accordingly, the scanning signal $VH_{21}$ changes from the −17V voltage outputted by the power supply 230*b* to the +15V voltage outputted by the power supply 230*a*, i.e., from the predetermined voltage VgE to the gate-on voltage VgH.

2.4 Effect

As in the first embodiment, the predetermined voltage VgE can eliminate a charge accumulated in the vicinity of the channel region of the TFT 120, and therefore it is possible to suppress characteristic changes due to a long period of conduction to the liquid crystal display device. Also, the predetermined voltage VgE is applied to each of the scanning signal lines $G_{(1)}$ to $G_{(2n)}$ immediately before application of the gate-on voltage VgH, and therefore it is possible to hold a voltage corresponding to video to be displayed in the pixel capacitance $C_p$ with a charge accumulated in the vicinity of the channel region of the TFT 120 being eliminated. Thus, the liquid crystal display device can suppress a reduction of the blurring voltage, thereby achieving higher-quality video display than in the first embodiment.

3. Third Embodiment

3.1 Overall Configuration and Operation

Figure 11:
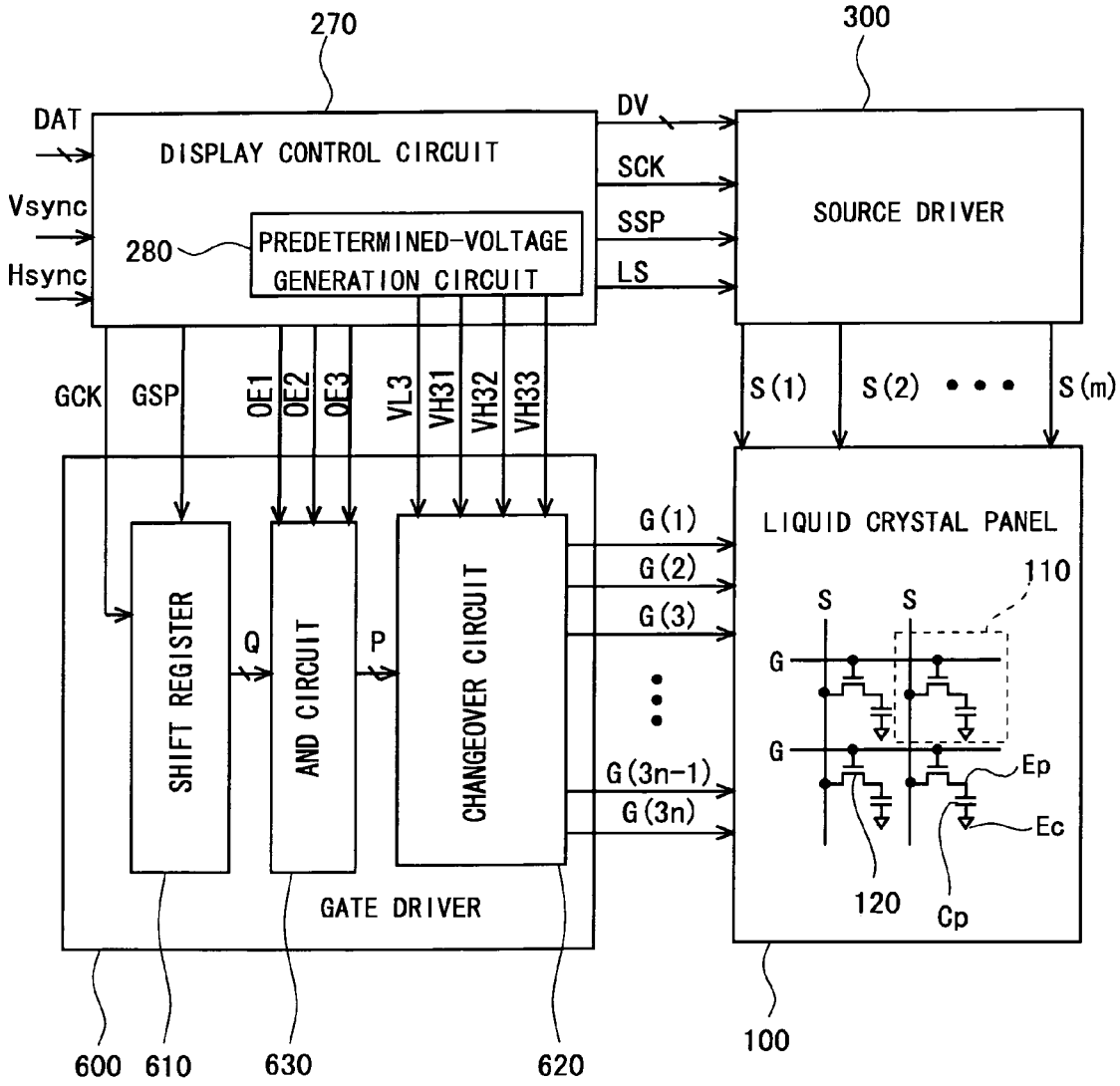
FIG. 11 is a block diagram illustrating the overall configuration of an active-matrix liquid crystal display device according to a third embodiment of the present invention.

FIG. 11 is a block diagram illustrating the overall configuration of an active-matrix liquid crystal display device according to a third embodiment of the present invention. Elements of the liquid crystal display device that are the same as those of the liquid crystal display device according to the second embodiment are denoted by the same reference characters, and any descriptions thereof will be omitted.

Unlike in the second embodiment, the liquid crystal display device is driven by a gate driver 600 provided with a plurality (3n) of scanning signal lines $G_{(1)}$ to $G_{(3n)}$ in the liquid crystal panel 100. The gate driver 600 is made up of a shift register 610, an AND circuit 630, and a changeover circuit 620. The shift register 610 sequentially outputs pulse signals $Q_{(1)}$ to $Q_{(3)}$ to the AND circuit 630 based on a gate start pulse signal GSP and a gate clock signal GCK outputted by the display control circuit 270. The AND circuit 630 generates pulse signals $P_{(1)}$ to $P_{(n)}$ by obtaining logical products of the pulse signals $Q_{(1)}$ to $Q_{(3n)}$ and output enable signals (hereinafter, referred to as "OE signals") $OE_1$ to $OE_3$ provided by the display control circuit 270, and sequentially outputs the generated pulse signals $P_{(1)}$ to $P_{(n)}$ to the changeover circuit 620.

Based on the pulse signal $P_{(1)}$ to $P_{(n)}$ provided by the AND circuit 630, the changeover circuit 620 selects either a scanning signal $VH_{31}$, $VH_{32}$, or $VH_{33}$ or a scanning signal $VL_3$ outputted by a predetermined-voltage generation circuit 280 provided in the display control circuit 270, and sequentially outputs it to the scanning signal lines $G_{(1)}$ to $G_{(3n)}$.

3.2 Configuration and Operation of the Gate Driver

Figure 12:
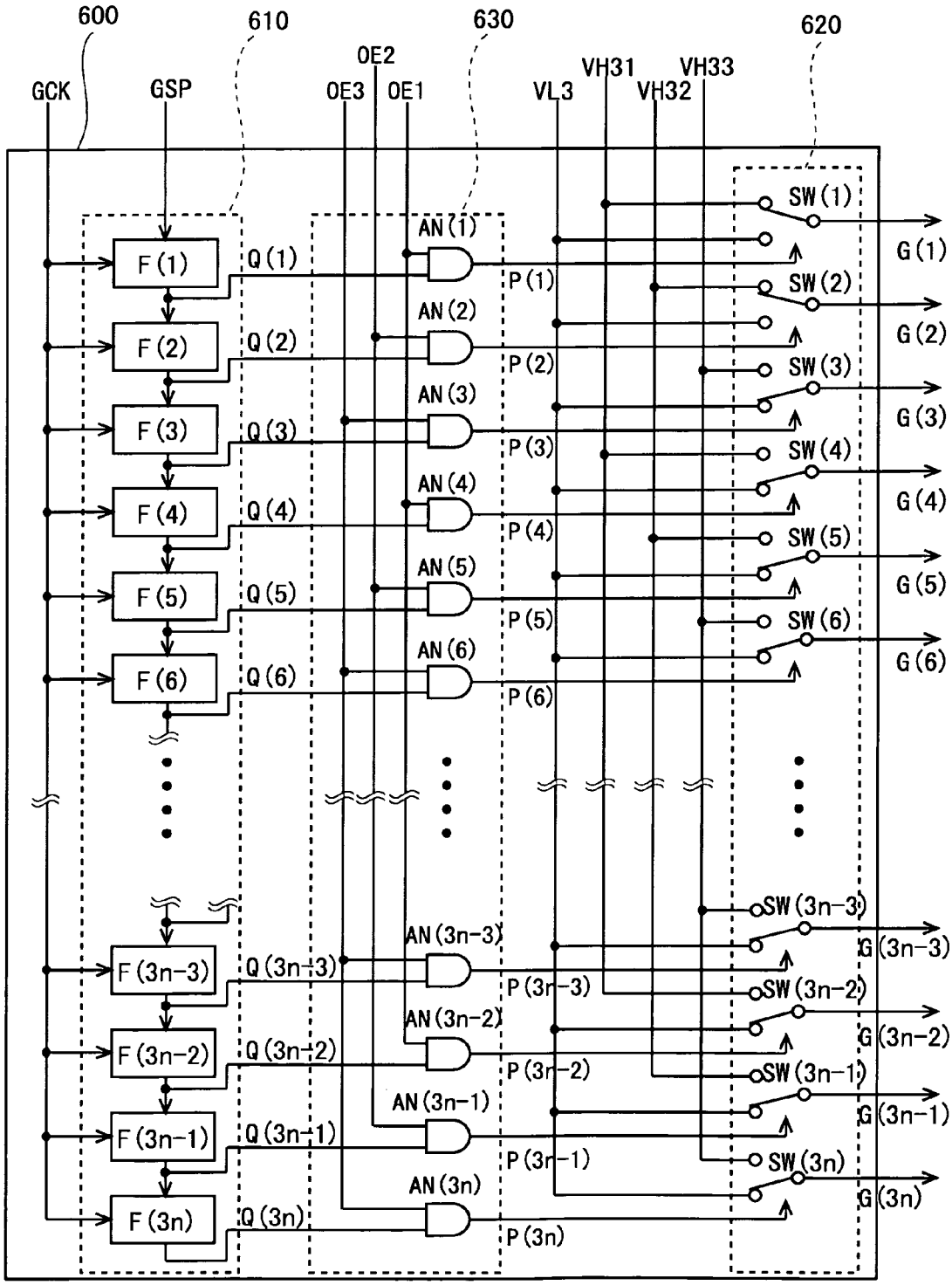
FIG. 12 is a circuit diagram illustrating the configuration of a gate driver included in the liquid crystal display device shown in FIG. 11.

FIG. 12 is a circuit diagram illustrating the configuration of the gate driver 600 included in the liquid crystal display device of the third embodiment. As shown in FIG. 12, the gate driver 600 is made up of the shift register 610 having 3n flip-flops $F_{(1)}$ to $F_{on}$) cascaded, the AND circuit 630 consisting of 3n two-input AND circuits $AN_{(1)}$ to $AN_{(3n)}$ to which outputs from the 3n flip-flops $F_{(1)}$ to $F_{(3n)}$ and the OE signals $OE_1$ to $OE_3$ are inputted, and the changeover circuit 620 consisting of 3n selection switches $SW_{(1)}$ to $SW_{(3n)}$ provided so as to be turned on/off in accordance with their respective outputs from the 3n AND circuits $AN_{(1)}$ to $AN_{(3n)}$.

When the gate start pulse signal GSP and the gate clock signal GCK are provided to the first-stage flip-flop $F_{(1)}$ of the shift register 610, the flip-flop $F_{(1)}$ generates a pulse signal $Q_{(1)}$ having a width determined by the gate start pulse signal GSP and the gate clock signal GCK, and outputs it to the AND circuit $AN_{(1)}$ and the second-stage flip-flop $F_{(2)}$. Based on the gate clock signal GCK, the second-stage flip-flop $F_{(2)}$ outputs a pulse signal $Q_{(2)}$, which has the same pulse width as the pulse signal $Q_{(1)}$ but is delayed by 1H period, to the AND circuit $AN_{(2)}$ and the third-stage flip-flop $F_{(3)}$. Thereafter, in a similar manner, pulse signals $Q_{(i)}$ with the same pulse width are sequentially outputted at intervals of 1H period. Then, the 3n'th-stage flip-flop $F_{(3n)}$ outputs the pulse signal $Q_{(3n)}$ to the AN circuit$_{(3n)}$.

The 3n two-input AND circuits $AN_{(1)}$ to $AN_{(3n)}$ receive at one terminal their respective pulse signals $Q_{(1)}$ to $Q_{(3n)}$ outputted by the flip-flops $F_{(1)}$ to $F_{(3n)}$. Also, the AND circuits $AN_{(1)}$ to $AN_{(3n)}$ receive at the other input terminal any of the OE signals $OE_1$ to $OE_3$ from the display control circuit 270. Specifically, the (3i-2)' th (where i is an integer from 1 to n) AND circuit $AN_{(3i-2)}$ receives the OE signal $OE_1$, the (3i-1)' th AND circuit $AN_{(3i-1)}$ receives the OE signal $OE_2$, and the 3i'th AND circuit $AN_{(3i)}$ receives the OE signal $OE_3$.

The AND circuit $AN_{(3i-2)}$ obtains a logical product of the pulse signal $Q_{(3i-2)}$ and the OE signal $OE_1$, and outputs it to the selection switch $SW_{(3i-2)}$ as a pulse signal $P_{(3i-2)}$. The AND circuit $AN_{(3i-1)}$ obtains a logical product of the pulse signal $Q_{(3i-1)}$ and the OE signal $OE_2$, and outputs it to the selection switch $SW_{(3i-1)}$ as a pulse signal $P_{(3i-1)}$. The AND circuit $AN_{(3i)}$ obtains a logical product of the pulse signal $Q_{(3i)}$ and the OE signal $OE_3$, and outputs it to the selection switch $SW_{(3i)}$ as a pulse signal $P_{(3i)}$.

Of the 3n selection switches $SW_{(1)}$ to $SW_{(3n)}$, the selection switch $SW_{(3i-2)}$ receives the scanning signal $VH_{31}$ at one input terminal and the scanning signal $VL_3$ at the other input terminal. The selection switch $SW_{(3i-2)}$ selects either the scanning signal $VH_{31}$ or $VL_3$ based on the pulse signal $P_{(3i-2)}$ provided by the AND circuit $AN_{(3i-2)}$, and outputs the selected scanning signal to the scanning signal line $G_{(3i-2)}$.

The selection switch $SW_{(3i-1)}$ receives the scanning signal $VH_{32}$ at one input terminal and the scanning signal $VL_3$ at the other input terminal. The selection switch $SW_{(3i-1)}$ selects either the scanning signal $VH_{32}$ or $VL_3$ based on the pulse signal $P_{(3i-1)}$ provided by the AND circuit $AN_{(3i-1)}$, and outputs the selected scanning signal to the scanning signal line $G_{(3i-1)}$.

The selection switch $SW_{(3i)}$ receives the scanning signal $VH_{33}$ at one input terminal and the scanning signal $VL_3$ at the other input terminal. The selection switch $SW_{(3i)}$ selects either the scanning signal $VH_{33}$ or $VL_3$ based on the pulse signal $P_{(3i)}$ provided by the AND circuit $AN_{(3i)}$, and outputs the selected scanning signal to the scanning signal line $G_{(3i)}$.

Figure 13:
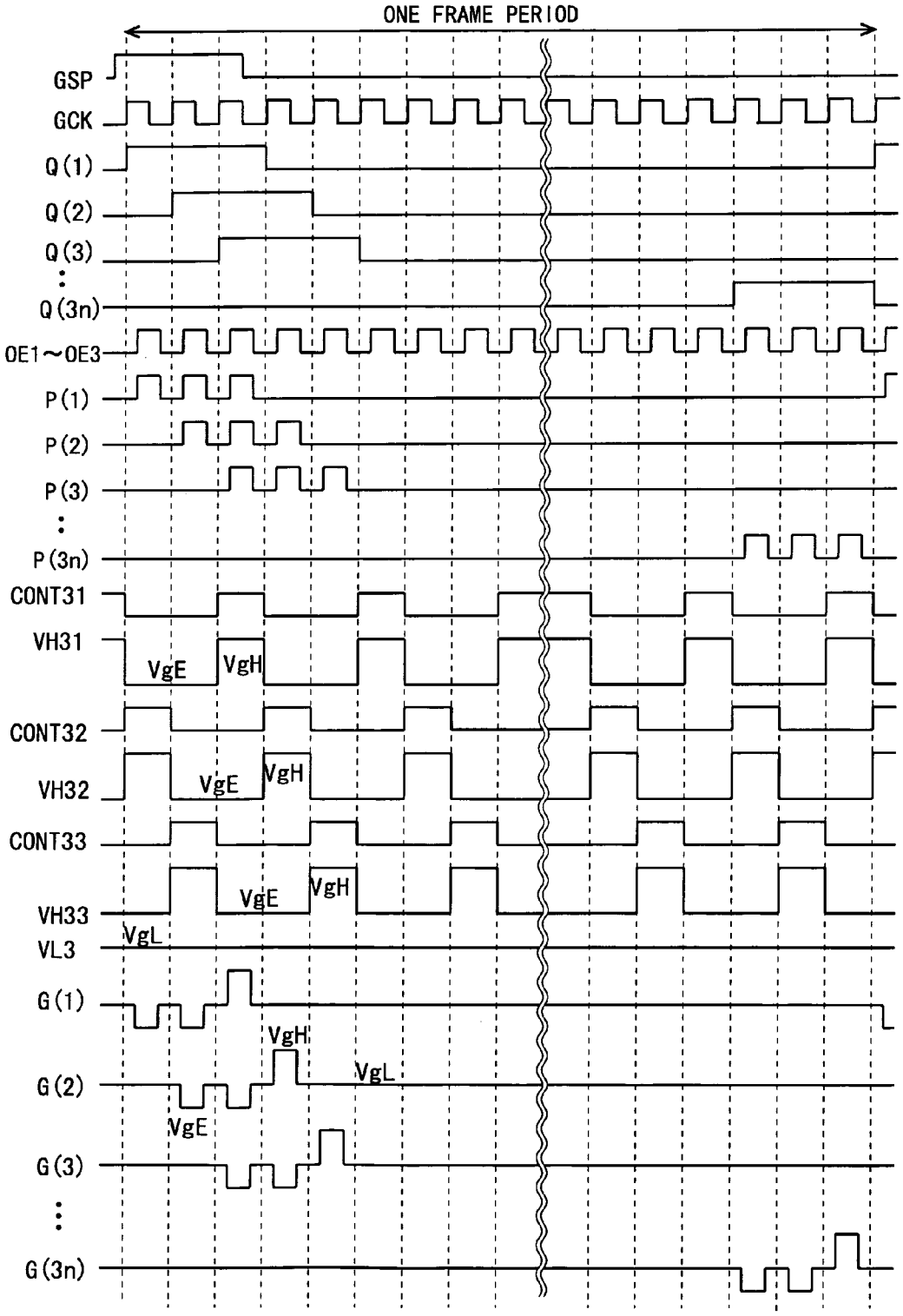
FIG. 13 is a signal waveform chart illustrating the operation of the liquid crystal display device shown in FIG. 11 for one frame period.

FIG. 13 is a signal waveform chart illustrating the operation of the liquid crystal display device of the third embodiment for one frame period. The shift register 610 is provided with the gate start pulse signal GSP and the gate clock signal GCK. The pulse signal $Q_{(1)}$ outputted by the first-stage flip-flop $F_{(1)}$ rises at the rise of the first pulse of the gate clock signal GCK, and the pulse signal $Q_{(1)}$ falls at the rise of the fourth pulse of the gate clock signal GCK.

The pulse signal $Q_{(2)}$ outputted by the second-stage flip-flop $F_{(2)}$ rises at the rise of the second pulse of the gate clock signal GCK, and the pulse signal $Q_{(2)}$ falls at the rise of the fifth pulse of the gate clock signal GCK. Also, the pulse signal $Q_{(3)}$ outputted by the third-stage flip-flop $F_{(3)}$ rises at the rise of the third pulse of the gate clock signal GCK, and the pulse signal $Q_{(3)}$ falls at the rise of the sixth pulse of the gate clock signal GCK. Thereafter, in a similar manner, pulse signals $Q_{(i)}$ are sequentially generated, and lastly, the pulse signal $Q_{(3n)}$ is generated.

The AND circuit $AN_{(1)}$ is provided with the pulse signal $Q_{(1)}$ outputted by the flip-flop $F_{(1)}$ at one input terminal and the OE signal $OE_1$ at the other input terminal. The OE signal $OE_1$ is a signal which changes from low level to high level and then to low level within 1H period. The AND circuit $AN_{(1)}$ obtains a logical product of the pulse signal $Q_{(3)}$ and the OE signal $OE_1$, and outputs it as the pulse signal $P_{(1)}$. Accordingly, the pulse signal $P_{(1)}$ is set to high level for a period in which both the pulse signal $Q_{(1)}$ and the OE signal $OE_1$ are at high level, and is a low-level signal during other periods.

The OE signals $OE_2$ and $OE_3$ are signals which repeatedly alternate between low and high levels simultaneously with the OE signal $OE_1$. Therefore, the pulse signal $P_{(2)}$ outputted by the AND circuit $AN_{(2)}$ is set to high level for a period in which both the pulse signal $Q_{(2)}$ and the OE signal $OE_2$ are at high level, and is a low-level signal during other periods. Also, the pulse signal $P_{(3)}$ outputted by the AND circuit $AN_{(3)}$ is set to high level for a period in which both the pulse signal $Q_{(3)}$ and the OE signal $OE_3$ are at high level, and is a low-level signal during other periods. Thereafter, in a similar manner, high- or low-level pulse signals $P_{(i)}$ outputted by the AND circuits AN(i) are provided to the selection switches $SW_{(i)}$.

While the foregoing has described the case where the AND circuits $AN_{(3i-2)}$, $AN_{(3i-1)}$, and $AN_{(3i)}$ have the OE signals $OE_1$, $OE_2$, and $OE_3$ inputted to their respective input terminals, the OE signals $OE_1$ to $OE_3$ are all the same. Therefore, the OE signals $OE_1$ to $OE_3$ may be united as one OE signal OE. In this case, the display control circuit 270 outputs the OE signal OE to the AND circuit 630 from one output terminal. The OE signal OE inputted to the AND circuit 630 is provided to the input terminal of each of the AND circuits $AN_{(i)}$ to $AN_{(3n)}$ via one signal line.

The scanning signals $VH_{31}$, $VH_{32}$, and $VH_{33}$ are all signals generated by the predetermined-voltage generation circuit 280 and change alternatingly between the gate-on voltage VgH and the predetermined voltage VgE at predetermined times which are different between the scanning signals $VH_{31}$, $VH_{32}$, and $VH_{33}$, as will be described later. More specifically, the scanning signal $VH_{31}$ assumes the predetermined voltage VgE when the first and second pulses of the pulse signal $P_{(3i-2)}$ are at high level and assumes the gate-on voltage VgH when the third pulse is at high level. The scanning signal $VH_{32}$ assumes the predetermined voltage VgE when the first and second pulses of the pulse signal $P_{(3i-1)}$ are at high level and assumes the gate-on voltage VgH when the third pulse is at high level. The scanning signal $VH_{33}$ assumes the predetermined voltage VgE when the first and second pulses of the pulse signal $P_{(3i)}$ are at high level and assumes the gate-on voltage VgH when the third pulse is at high level. Also, the scanning signal $VL_3$ always assumes the gate-off voltage VgL.

Where the selection switch $SW_{(1)}$ has the scanning signal $VH_{31}$ inputted to one input terminal and the scanning signal $VL_3$ to the other input terminal and the AND circuit $AN_{(1)}$ provides the pulse signal $P_{(1)}$ to the selection switch $SW_{(1)}$, the selection switch $SW_{(1)}$ outputs the scanning signal $VH_{31}$ to the scanning signal line $G_{(1)}$ if the pulse signal $P_{(1)}$ is at high level and outputs the scanning signal $VL_3$ if the pulse signal $P_{(1)}$ is at low level. Specifically, during the first and second 1H periods, the scanning signal $VH_{31}$ assumes the predetermined voltage VgE when the pulse signal $P_{(1)}$ is at high level, and therefore the predetermined voltage VgE is outputted to the scanning signal line $G_{(1)}$. Also, during the third 1H period, the scanning signal $VH_{31}$ assumes the gate-on voltage VgH when the pulse signal $P_{(1)}$ is at high level, and therefore the gate-on voltage VgH is outputted to the scanning signal line $G_{(1)}$. When neither the predetermined voltage VgE nor the gate-on voltage VgH is outputted, the gate-off voltage VgL is outputted to the scanning signal line $G_{(1)}$.

Where the selection switch $SW_{(2)}$ has the scanning signal $VH_{32}$ inputted to one input terminal and the scanning signal $VL_3$ to the other input terminal, and the AND circuit $AN_{(2)}$ provides the pulse signal $P_{(2)}$ to the selection switch $SW_{(2)}$, the selection switch $SW_{(2)}$ outputs the scanning signal $VH_{32}$ to the scanning signal line $G_{(2)}$ if the pulse signal $P_{(2)}$ is at high level and outputs the scanning signal $VL_3$ if the pulse signal $P_{(2)}$ is at low level. Specifically, during the second and third 1H periods, the scanning signal $VH_{32}$ assumes the predetermined voltage VgE when the pulse signal $P_{(2)}$ is at high level, and therefore the predetermined voltage VgE is outputted to the scanning signal line $G_{(2)}$. Also, during the fourth 1H period, the scanning signal $VH_{32}$ assumes the gate-on voltage VgH when the pulse signal $P_{(2)}$ is at high level, and therefore the gate-on voltage VgH is outputted to the scanning signal line $G_{(2)}$. When neither the predetermined voltage VgE nor the gate-on voltage VgE is outputted, the gate-off voltage VgL is outputted to the scanning signal line $G_{(2)}$.

Where the selection switch $SW_{(3)}$ has the scanning signal $VH_{33}$ inputted to one input terminal and the scanning signal $VL_3$ to the other input terminal and the AND circuit $AN_{(3)}$ provides the pulse signal $P_{(3)}$ to the selection switch $SW_{(3)}$, the selection switch $SW_{(3)}$ outputs the scanning signal $VH_{33}$ to the scanning signal line $G_{(3)}$ if the pulse signal $P_{(3)}$ is at high level and the selection switch $SW_{(3)}$ outputs the scanning signal $VL_3$ if the pulse signal $P_{(3)}$ is at low level. Specifically, during the third and fourth 1H periods, the scanning signal $VH_{33}$ assumes the predetermined voltage VgE when the pulse signal $P_{(3)}$ is at high level, and therefore the predetermined voltage VgE is outputted to the scanning signal line $G_{(3)}$. Also, during the fifth 1H period, the scanning signal $VH_{33}$ assumes the gate-on voltage VgH when the pulse signal $P_{(3)}$ is at high level, and therefore the gate-on voltage VgH is outputted to the scanning signal line $G_{(3)}$. When neither the predetermined voltage VgE nor the gate-on voltage VgH is outputted, the gate-off voltage VgL is outputted to the scanning signal line $G_{(3)}$.

In this manner, the selection switch $SW_{(i)}$ sequentially outputs the predetermined voltage VgE, the gate-on voltage VgH, and the gate-off voltage VgL to the scanning signal line $G_{(i)}$ for a predetermined period per 1H period from the i'th 1H period.

As described above, over two cycles of the gate clock signal GCK, the predetermined voltage VgE is applied to the scanning signal lines $G_{(1)}$ to $G_{(3n)}$ once per predetermined period within one cycle of the gate clock signal GCK. Subsequently, the gate-on voltage VgH is applied for the predetermined period within the next cycle to bring the TFT 120 into on state, thereby providing a potential corresponding to video to be displayed to the pixel capacitance $C_p$. Then, the gate-off voltage VgL is applied to bring the TFT 120 into off state, thereby holding the provided potential in the pixel capacitance $C_p$.

3.3 Predetermined-Voltage Generation Circuit

Figure 14:
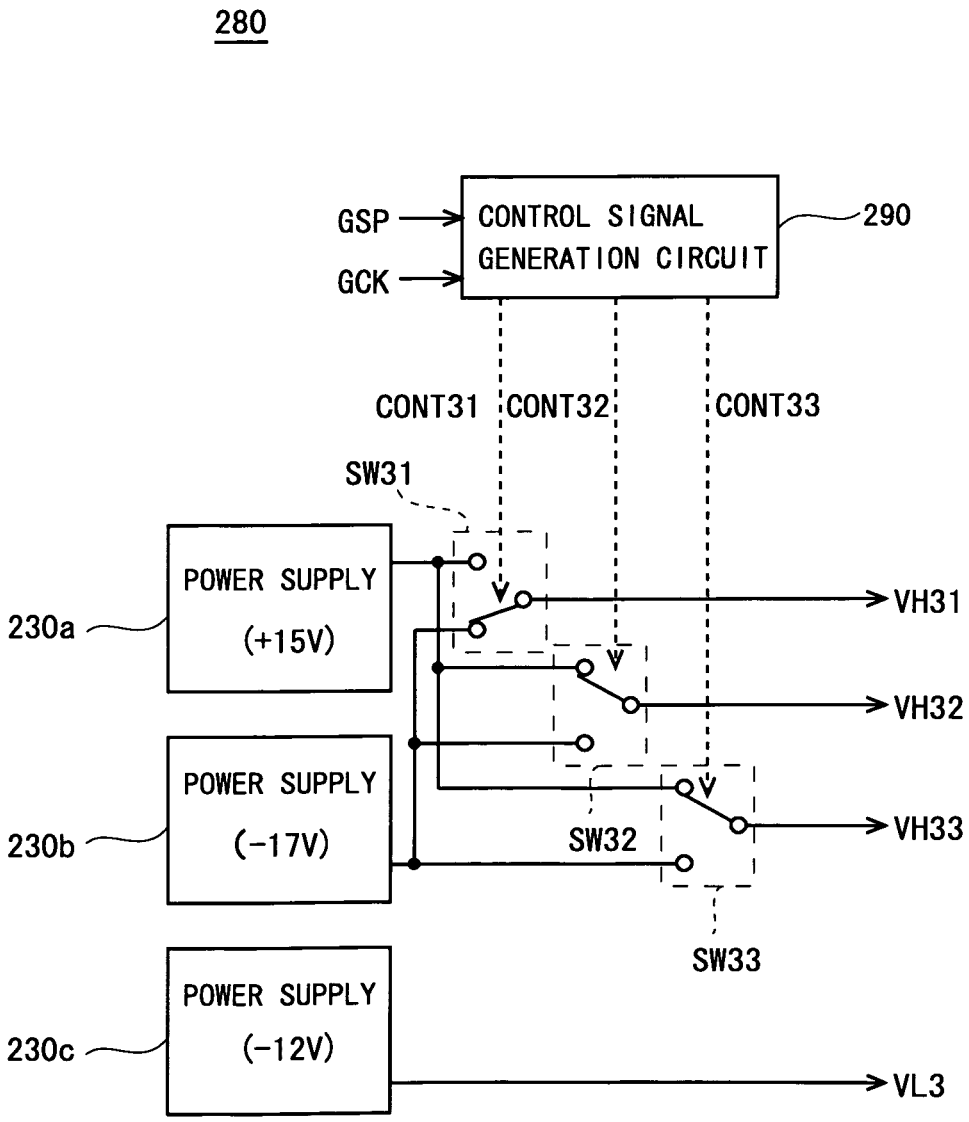
FIG. 14 is a block diagram illustrating the configuration of a predetermined-voltage generation circuit included in the liquid crystal display device shown in FIG. 11.

FIG. 14 is a block diagram illustrating the configuration of the predetermined-voltage generation circuit 280 included in the liquid crystal display device of the third embodiment. The predetermined-voltage generation circuit 280 is provided with a control signal generation circuit 290 for generating a fifth control signal $CONT_{31}$, a sixth control signal $CONT_{32}$ and a seventh control signal $CONT_{33}$, a power supply 230*a* for outputting a +15V voltage, a power supply 230*b* for outputting a −17V voltage, a power supply 230*c* for outputting a −12V voltage, and switches $SW_{31}$, $SW_{32}$, and $SW_{33}$ for selecting either the output voltage of the power supply 230*a* or the output voltage of the power supply 230*c* and outputting it as a scanning signal $VH_{31}$, $VH_{32}$, or $VH_{33}$, as shown in FIG. 14.

The control signal generation circuit 290 generates the fifth control signal $CONT_{31}$, the sixth control signal $CONT_{32}$ and the seventh control signal $CONT_{33}$ based on the gate start pulse signal GSP and the gate clock signal GCK generated in the display control circuit 270. The generated fifth control signal $CONT_{31}$ controls the switch $SW_{31}$, the sixth control signal $CONT_{32}$ controls the switch $SW_{32}$ at different times from the switch $SW_{31}$, and the seventh control signal $CONT_{33}$ controls the switch $SW_{33}$ at different times from the switches $SW_{31}$ and $SW_{32}$. Also, the +15V voltage outputted by the power supply 230*a*, the −17V voltage outputted by the power supply 230*b*, and the −12V voltage outputted by the power supply 230*c* are outputted to the gate driver 600 as the gate-on voltage VgH, the predetermined voltage VgE, and the gate-off voltage VgL, respectively.

When the fifth control signal $CONT_{31}$ is set to low level, the input of the switch $SW_{31}$ connects to the output terminal of the power supply 230*b*, disconnecting from the output terminal of the power supply 230*a*. Accordingly, the scanning signal $VH_{31}$ changes from the +15V voltage signal outputted by the power supply 230*a* to the −17V voltage signal outputted by the power supply 230*b*, i.e., from the gate-on voltage VgH to the predetermined voltage VgE.

Also, when the fifth control signal $CONT_{31}$ is set to high level, the input of the switch $SW_{31}$ connects to the output terminal of the power supply 230*a*, disconnecting from the output terminal of the power supply 230*b*. Accordingly, the scanning signal $VH_{31}$ changes from the −17V voltage signal outputted by the power supply 230*b* to the +15V voltage signal outputted by the power supply 230*a*, i.e., from the predetermined voltage VgE to the gate-on voltage VgH.

Similarly, when the sixth control signal $CONT_{32}$ is set to low level, the input of the switch $SW_{32}$ connects to the output terminal of the power supply 230*b*, disconnecting from the output terminal of the power supply 230*a*. Accordingly, the scanning signal $VH_{32}$ changes from the +15V voltage signal outputted by the power supply 230*a* to the −17V voltage signal outputted by the power supply 230*b*, i.e., from the gate-on voltage VgH to the predetermined voltage VgE.

Also, when the sixth control signal $CONT_{32}$ is set to high level, the input of the switch $SW_{32}$ connects to the output terminal of the power supply 230*a*, disconnecting from the output terminal of the power supply 230*b*. Accordingly, the scanning signal $VH_{32}$ changes from the −17V voltage signal outputted by the power supply 230*b* to the +15V voltage signal outputted by the power supply 230*a*, i.e., from the predetermined voltage VgE to the gate-on voltage VgH.

When the seventh control signal $CONT_{33}$ is set to low level, the input of the switch $SW_{33}$ connects to the output terminal of the power supply 230*b*, disconnecting from the output terminal of the power supply 230*a*. Accordingly, the scanning signal $VH_{33}$ changes from the +15V voltage outputted by the power supply 230*a* to the −17V voltage outputted by the power supply 230*b*, i.e., from the gate-on voltage VgH to the predetermined voltage VgE.

Also, when the seventh control signal $CONT_{33}$ is set to high level, the input of the switch $SW_{33}$ connects to the output terminal of the power supply 230*a*, disconnecting from the output terminal of the power supply 230*b*. Accordingly, the scanning signal $VH_{33}$ changes from −17V outputted by the power supply 230*b* to +15V outputted by the power supply 230*a*, i.e., from the predetermined voltage VgE to the gate-on voltage VgH.

3.4 Effect

In the liquid crystal display device according to the third embodiment, the predetermined voltage VgE is applied twice to each of the scanning signal lines $G_{(1)}$ to $G_{(3n)}$, resulting in a longer application period of the predetermined voltage VgE than in the second embodiment. Accordingly, it is possible to eliminate more charge accumulated in the vicinity of the channel region of the TFT 120. Thus, the liquid crystal display device can further suppress characteristic changes caused by a long period of conduction, thereby achieving higher-quality video display than in the second embodiment.

Note that the number of times the predetermined voltage VgE is applied to each of the scanning signal lines $G_{(1)}$ to $G_{(3n)}$ may be set to three times or more. In such a case, more charge accumulated in the vicinity of the channel region of the TFT 120 can be eliminated, achieving further higher-quality video display.

3.5 Variant

Figure 15:
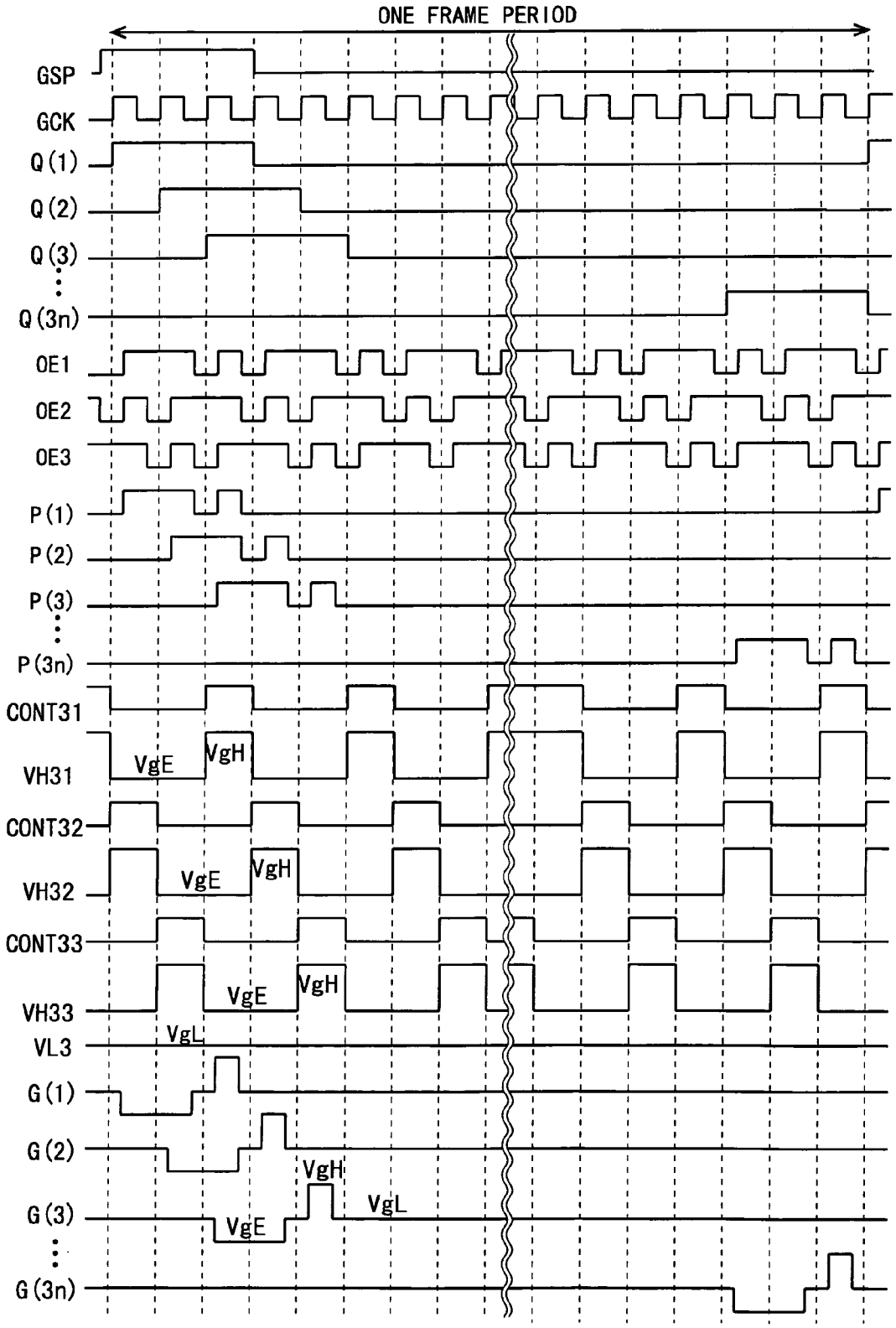
FIG. 15 is a signal waveform chart illustrating the operation of a variant of the liquid crystal display device shown in FIG. 11 for one frame period.

FIG. 15 is a signal waveform chart illustrating the operation of a variant of the liquid crystal display device of the third embodiment for one frame period. As shown in FIG. 15, waveforms of the OE signals $OE_1$ to $OE_3$ differ from those in the signal waveform chart of FIG. 13. Specifically, the OE signals $OE_1$ to $OE_3$ in FIG. 13 are signals that repeatedly alternate between high and low levels at the same time, as described above. On the other hand, the OE signals $OE_1$ to $OE_3$ in FIG. 15 are all set to high level from some point in the first 1H period within each unit of three successive 1H periods to some point in the second 1H period, and as in the case of the OE signals $OE_1$ to $OE_3$ in FIG. 13, the signals are set to low level before and after a point in the third 1H period at which they are set to high level. Also, the OE signals $OE_1$ to $OE_3$ in FIG. 15 are sequentially outputted at intervals of 1H period.

The AND circuit $AN_{(1)}$ is provided with the pulse signal $Q_{(1)}$ outputted by the flip-flop $F_{(1)}$ at one input terminal and the OE signal $OE_1$ at the other input terminal. The AND circuit $AN_{(1)}$ obtains a logical product of the pulse signal $Q_{(1)}$ and the OE signal $OE_1$, and outputs it as a pulse signal $P_{(1)}$. Accordingly, the pulse signal $P_{(1)}$ is set to high level for a period in which both the pulse signal $Q_{(1)}$ and the OE signal $OE_1$ are at high level, and is a low-level signal during other periods. Specifically, the pulse signal $P_{(1)}$ is set to high level from some point in the first 1H period to some point in the second 1H period, and also set to high level at some point in the third 1H period.

Thereafter, in a similar manner, the pulse signal $P_{(2)}$ outputted by the AND circuit $AN_{(2)}$ is set to high level from some point in the second 1H period to some point in the third 1H period, and also set to high level at some point in the fourth 1H period. Also, the pulse signal $P_{(3)}$ outputted by the AND circuit $AN_{(3)}$ is set to high level from some point in the third 1H period to some point in the fourth 1H period, and also set to high level at some point in the fifth 1H period.

On the other hand, the scanning signals $VH_{31}$ to $VH_{33}$ repeatedly alternate between the gate-on voltage VgH and the predetermined voltage VgE at the same predetermined times as the scanning signals $VH_{31}$ to $VH_{33}$, respectively, in FIG. 13, while the scanning signal $VL_3$ always assumes the gate-off voltage VgL.

Therefore, the selection switch $SW_{(1)}$ selects the scanning signal $VH_{31}$ from the point in the first 1H period at which the pulse signal $P_{(1)}$ is at high level to some point in the second 1H period. During this period, the scanning signal $VH_{31}$ assumes the predetermined voltage VgE, and therefore the predetermined voltage VgE is outputted to the scanning signal line $G_{(1)}$. Also, during the third 1H period, the scanning signal $VH_{31}$ assumes the gate-on voltage VgH when the pulse signal $P_{(1)}$ is at high level, and therefore the gate-on voltage VgH is outputted to the scanning signal line $G_{(1)}$. Note that during the time other than periods in which the predetermined voltage VgE and the gate-on voltage VgH are outputted, the gate-off voltage VgL is outputted to the scanning signal line $G_{(1)}$.

Similarly, the selection switch $SW_{(2)}$ selects the scanning signal $VH_{32}$ from the point in the second 1H period at which the pulse signal $P_{(2)}$ is at high level to some point in the third 1H period. During this time, the scanning signal $VH_{32}$ assumes the predetermined voltage VgE, and therefore the predetermined voltage VgE is outputted to the scanning signal line $G_{(2)}$. Also, during the fourth 1H period, the scanning signal $VH_{32}$ assumes the gate-on voltage VgH when the pulse signal $P_{(2)}$ is at high level, the gate-on voltage VgH is outputted to the scanning signal line $G_{(2)}$. Note that during the time other than periods in which the predetermined voltage VgE and the gate-on voltage VgH are outputted, the gate-off voltage VgL is outputted to the scanning signal line $G_{(2)}$.

Also, the selection switch $SW_{(3)}$ selects the scanning signal $VH_{33}$ from the point in the third 1H period at which the pulse signal $P_{(3)}$ is at high level to some point in the fourth 1H period. During this time, the scanning signal $VH_{33}$ assumes the predetermined voltage VgE, and therefore the predetermined voltage VgE is outputted to the scanning signal line $G_{(3)}$. Also, during the fifth 1H period, the scanning signal $VH_{33}$ assumes the gate-on voltage VgH when the pulse signal $P_{(3)}$ is at high level, and therefore the gate-on voltage VgH is outputted to the scanning signal line $G_{(3)}$. Note that during the time other than periods in which the predetermined voltage VgE and the gate-on voltage VgH are outputted, the gate-off voltage VgL is outputted to the scanning signal line $G_{(3)}$.

In this variant also, the period of application of the predetermined voltage VgE is longer than in the third embodiment, and therefore more charge accumulated in the vicinity of the channel region of the TFT 120 can be eliminated. Thus, the liquid crystal display device can suppress characteristic changes caused by a long period of conduction more than in the third embodiment, achieving further higher-quality video display.

4. Others

While the foregoing has described the case where the TFTs 120 in the first to third embodiments and their variants are N-channel TFTs, they may be P-channel TFTs. In the case where P-channel TFTs are used, however, it is necessary to reverse the polarity of the gate-on voltage VgH, the gate-off voltage VgL, and the predetermined voltage VgE with respect to those for the N-channel TFTs.

INDUSTRIAL APPLICABILITY

The present invention is applicable to matrix display devices, such as active-matrix liquid crystal display devices, and is particularly suitable for matrix display devices intended for a long period of use:

The invention claimed is:

1. An active-matrix display device for providing gradation display of video, comprising:

a display portion including a plurality of scanning signal lines, a plurality of video signal lines crossing the scanning signal lines, and pixel formation portions arranged in a matrix at corresponding intersections of the scanning signal lines and the video signal lines, the pixel formation portions each including a switching element to be brought into on or off state in accordance with a signal applied to a corresponding scanning signal line;

a scanning signal line driver circuit for selectively activating the scanning signal lines; and a video signal line driver circuit for applying a video signal representing video to be displayed to the video signal lines, wherein, the scanning signal lines include first and second scanning signal line groups each including a plurality of adjacent scanning signal lines, the scanning signal line driver circuit includes a first scanning signal line driver circuit for activating the first scanning signal line group and a second scanning signal line driver circuit for activating the second scanning signal line group, and the first and second scanning signal line driver circuits simultaneously apply a predetermined pulse to a respective one of the first and second scanning signal line groups during a period in which the respective one of the scanning signal line groups is not active and the other scanning signal line group is active, the predetermined pulse having the same polarity as an off voltage for bringing the switching element into off state and being at a higher level than the off voltage.

2. The display device according to claim 1, wherein, the scanning signal line driver circuit includes:

a successive-pulse generation circuit for generating a succession of pulses;

a predetermined-pulse generation circuit for generating the predetermined pulse based on a preceding group of pulses among the succession of pulses, and an activation-pulse generation circuit for generating activation pulses to activate the scanning signal lines based on following pulses.

3. The display device according to claim 2, wherein the predetermined-pulse generation circuit generates a succession of the predetermined pulses.

4. The display device according to claim 2, wherein the predetermined-pulse generation circuit generates the predetermined pulse having a pulse width of one horizontal period or more.

5. The display device according to claim 2, further comprising:

a first power supply for outputting a first voltage, a second power supply for outputting a second voltage, and a third power supply for outputting a third voltage, wherein, the scanning signal line driver circuit selectively applies the first, second, and third voltages to the scanning signal lines, such that the first voltage brings the switching element into on state, the second voltage brings the switching element into off state, and the third voltage eliminates a charge accumulated in the pixel formation portion.

6. An active-matrix display device for providing gradation display of video, comprising:

a display portion including a plurality of scanning signal lines, a plurality of video signal lines crossing the scanning signal lines, and pixel formation portions arranged in a matrix at corresponding intersections of the scanning signal lines and the video signal lines, the pixel formation portions each including a switching element to be brought into on or off state in accordance with a signal applied to a corresponding scanning signal line;

a scanning signal line driver circuit for selectively activating the scanning signal lines;

a video signal line driver circuit for applying a video signal representing video to be displayed to the video signal lines;

a first power supply for outputting a first voltage;

a second power supply for outputting a second voltage; and a third power supply for outputting a third voltage, wherein, the scanning signal lines include first and second scanning signal line groups each including of a plurality of adjacent scanning signal lines, the scanning signal line driver circuit includes a first scanning signal line driver circuit for activating the first scanning signal line group and a second scanning signal line driver circuit for activating the second scanning signal line group, the first and second scanning signal line driver circuits simultaneously apply a predetermined pulse to a respective one of the first and second scanning signal line groups during a period in which the respective one of the scanning signal line groups is not active and the other scanning signal line group is active, the predetermined pulse having the same polarity as an off voltage for bringing the switching element into off state and being at a higher level than the off voltage, and the scanning signal line driver circuit selectively applies the first, second, and third voltages to the scanning signal lines, such that the first voltage brings the switching element into on state, the second voltage brings the switching element into off state, and the third voltage eliminates a charge accumulated in the pixel formation portion.

7. The display device according to claim 6, further comprising:

first and second changeover means for changing between the second and third power supplies, wherein, the first changeover means makes a change from the second power supply to the third power supply and provides an output to the second scanning signal line driver circuit during a period in which the first scanning signal line group is active, and the second changeover means makes a change from the second power supply to the third power supply and provides an output to the first scanning signal line driver circuit during a period in which the second scanning signal line group is active.

8. The display device according to claim 6, further comprising:

third and fourth changeover means for changing between the first and third power supplies, wherein, the third changeover means makes a change between the first and third power supplies and sequentially provides outputs to the scanning signal line driver circuit, the fourth changeover means makes a change between the first and third power supplies with opposite phases to the third changeover means, and sequentially provides outputs to the scanning signal line driver circuit, and the scanning signal line driver circuit sequentially applies the first and third voltages to the scanning signal lines such that one of the voltages is applied to odd-numbered ones of the scanning signal lines and the other voltage to even-numbered ones of the scanning signal lines.

9. The display device according to claim 6, further comprising:

fifth, sixth, and seventh changeover means for changing between the first and third power supplies, wherein, the fifth changeover means makes a change between the first and third power supplies and sequentially provides outputs to the scanning signal line driver circuit, the sixth changeover means makes a change between the first and third power supplies with opposite phases to the fifth changeover means, and sequentially provides outputs to the scanning signal line driver circuit, the seventh changeover means makes a change between the first and third power supplies with different phases from the fifth and sixth changeover means, and sequentially provides outputs to the scanning signal line driver circuit, and the scanning signal line driver circuit sequentially selects the fifth, sixth, and seventh changeover means in a cyclical manner, and applies the third voltage and then the first voltage to the scanning signal lines while sequentially shifting the phases of the voltages line by line.

* * * * *

UNITED STATES PATENT AND TRADEMARK OFFICE

CERTIFICATE OF CORRECTION

PATENT NO. : 8,786,542 B2
APPLICATION NO. : 12/735652
DATED : July 22, 2014
INVENTOR(S) : Takashi Morimoto It is certified that error appears in the above-identified patent and that said Letters Patent is hereby corrected as shown below:

On the Title Page, Item (22) should read

(22) PCT Filed: Feb. 3, 2009

Signed and Sealed this
Twenty-third Day of December, 2014

Michelle K. Lee

Michelle K. Lee
*Deputy Director of the United States Patent and Trademark Office*